US012429270B2

(12) United States Patent
Nuss et al.

(10) Patent No.: US 12,429,270 B2
(45) Date of Patent: Sep. 30, 2025

(54) REFRIGERATOR APPLIANCES AND REMOVABLE ICE MAKING ASSEMBLIES

(71) Applicant: Haier US Appliance Solutions, Inc., Wilmington, DE (US)

(72) Inventors: Bart Andrew Nuss, Fisherville, KY (US); Alan Joseph Mitchell, Louisville, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 223 days.

(21) Appl. No.: 18/163,554

(22) Filed: Feb. 2, 2023

(65) Prior Publication Data

US 2024/0263861 A1 Aug. 8, 2024

(51) Int. Cl.

| | |
|---|---|
| ***F25C 5/06*** | (2006.01) |
| ***F25C 1/04*** | (2018.01) |
| ***F25C 1/22*** | (2018.01) |
| ***F25C 5/04*** | (2006.01) |

(52) U.S. Cl.

CPC ..... *F25C 5/06* (2013.01); *F25C 1/04* (2013.01); *F25C 1/22* (2013.01); *F25C 5/04* (2013.01); *F25C 2400/10* (2013.01)

(58) Field of Classification Search

CPC ..... F25C 1/04; F25C 1/22

See application file for complete search history.

(56) References Cited

U.S. PATENT DOCUMENTS

| | | | | |
|---|---|---|---|---|
| 2,912,835 | A * | 11/1959 | Modes | F25C 1/04 62/353 |
| 3,060,700 | A * | 10/1962 | De Vincent | F25C 1/04 62/353 |
| 3,217,510 | A * | 11/1965 | Kniffin | F25C 1/04 62/157 |
| 3,643,456 | A * | 2/1972 | Nichols | F25C 5/187 192/114 R |
| 3,783,636 | A * | 1/1974 | Archer | F25C 1/04 62/353 |

(Continued)

FOREIGN PATENT DOCUMENTS

| | | |
|---|---|---|
| CN | 106225364 A | 12/2016 |
| CN | 210718246 U | 6/2020 |

(Continued)

*Primary Examiner* — Christopher R Zerphey

(74) *Attorney, Agent, or Firm* — Dority & Manning, P.A.

(57) ABSTRACT

A refrigerator or ice making assembly may include a housing and a mold assembly. The housing may define a receiving chamber in fluid communication with an air duct. The housing may extend transversely from a first housing end and a second housing end. The housing may define a first mounting slot at the first housing end and a second mounting slot at the second housing end. The mold assembly may include a frame, a heat exchanger mounted to the frame, an ice mold, and a latch bar. The ice mold may be supported on the heat exchanger and define a mold cavity for receiving water. The latch bar may be movably mounted on the frame and extend transversely between the first housing end and the second housing end in selective locked engagement with the first and second mounting slots to secure the mold assembly to the housing.

18 Claims, 21 Drawing Sheets

(56) References Cited

U.S. PATENT DOCUMENTS 3,832,863 A * 9/1974 Boorman, Jr. ..... F25D 23/067 62/298
3,937,032 A * 2/1976 Bright ..... F25C 1/04 62/353
4,266,837 A * 5/1981 Barnard ..... F25C 1/12 312/351
4,649,718 A * 3/1987 Linstromberg ..... F25C 1/04 62/340
5,809,797 A * 9/1998 Ryu ..... F25C 1/24 62/340
6,438,988 B1 * 8/2002 Paskey ..... F25C 1/04 62/353
7,757,511 B2 * 7/2010 LeClear ..... F25C 1/04 62/340
8,424,334 B2 * 4/2013 Kang ..... F25C 5/22 62/340
9,146,050 B2 * 9/2015 Jeong ..... F25C 1/24
9,618,258 B2 * 4/2017 Shin ..... F25D 23/006
9,689,600 B2 * 6/2017 Jeong ..... F25C 1/04
9,739,516 B2 * 8/2017 Jeong ..... F25C 1/24
10,345,024 B2 * 7/2019 Besore ..... F25C 5/02
11,181,309 B2 * 11/2021 Shi ..... F25C 5/08
11,953,255 B2 * 4/2024 Ryu ..... F25C 5/24
2009/0031736 A1 * 2/2009 Su ..... F25C 5/187 62/137
2012/0017626 A1 * 1/2012 Hwang ..... F25D 23/04 62/340
2016/0216020 A1 * 7/2016 Safrin ..... F25C 1/04

FOREIGN PATENT DOCUMENTS

EP 3215797 B1 11/2018
JP 2001116410 A 4/2001

* cited by examiner 250
242
282
284
A
280
296
220

222
240
288

280, 286
θ

REFRIGERATOR APPLIANCES AND REMOVABLE ICE MAKING ASSEMBLIES

FIELD OF THE INVENTION

The present subject matter relates generally to refrigerator appliances, and more particularly to ice making assemblies for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

However, conventional ice making assemblies are large, inefficient, experience a variety of performance related issues, and only produce one shape or size of ice cube. For example, conventional twist tray icemakers include a partitioned plastic mold that is physically deformed to break the bond formed between ice and the tray. However, these icemakers require additional room to fully rotate and twist the tray. In addition, the ice cubes are frequently fractured during the twisting process. When this occurs, a portion of the cubes may remain in the tray, thus resulting in overfilling during the next fill process. Further, conventional ice making assemblies only offer one style of ice cube.

For instance, conventional crescent cube icemakers use a sweep arm to pass through the ice mold and eject the ice cubes. However, water may freeze in locations that cause the sweep arm to jam, resulting in an ejection failure and a stall in the ice making process. Certain conventional icemakers include a harvest heater that helps to release ice cubes from the mold, but such heaters are typically placed far from the water discharge spout where ice buildup may occur. As a result, these harvest heaters must be turned on for a long period of time in order to melt the entire cube and the clogged water spout, thus increasing energy consumption and adding significant time to the cube formation process.

Accordingly, a refrigerator appliance having an ice maker with improved versatility would be desirable. More particularly, an ice making assembly for a refrigerator appliance that is compact, efficient, reliable, or capable of forming more than one type of ice cube would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly of a refrigerator appliance is provided. The ice making assembly may include a housing and a mold assembly. The housing may define a receiving chamber in fluid communication with an air duct. The housing may extend transversely from a first housing end and a second housing end. The housing may define a first mounting slot at the first housing end and a second mounting slot at the second housing end. The mold assembly may be removably mounted to the housing. The mold assembly may include a frame, a heat exchanger, an ice mold, and a latch bar. The frame may be configured for receipt within the receiving chamber. The heat exchanger may be mounted to the frame. The ice mold may be supported on the heat exchanger and define a mold cavity for receiving water. The latch bar may be movably mounted on the frame and extend transversely between the first housing end and the second housing end in selective locked engagement with the first and second mounting slots to secure the mold assembly to the housing.

In another exemplary aspect of the present disclosure, an ice making assembly of a refrigerator appliance is provided. The ice making assembly may include a cabinet, a door, an icebox, and an ice making assembly. The cabinet may define a chilled chamber. The door may be rotatably mounted to the cabinet to provide selective access to the chilled chamber. The icebox may be mounted to the door and define an ice making chamber. The ice making assembly may be positioned within the ice making chamber. The ice making assembly may include a housing, a frame, a heat exchanger, an ice mold, and a latch bar. The housing may define a receiving chamber in fluid communication with an air duct. The housing may extend transversely from a first housing end and a second housing end. The housing may define a first mounting slot at the first housing end and a second mounting slot at the second housing end. The frame may be configured for receipt within the receiving chamber. The heat exchanger may be mounted to the frame. The ice mold may be supported on the heat exchanger and define a mold cavity for receiving water. The latch bar may be movably mounted on the frame and extend transversely between the first housing end and the second housing end in selective locked engagement with the first and second mounting slots to secure the frame to the housing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
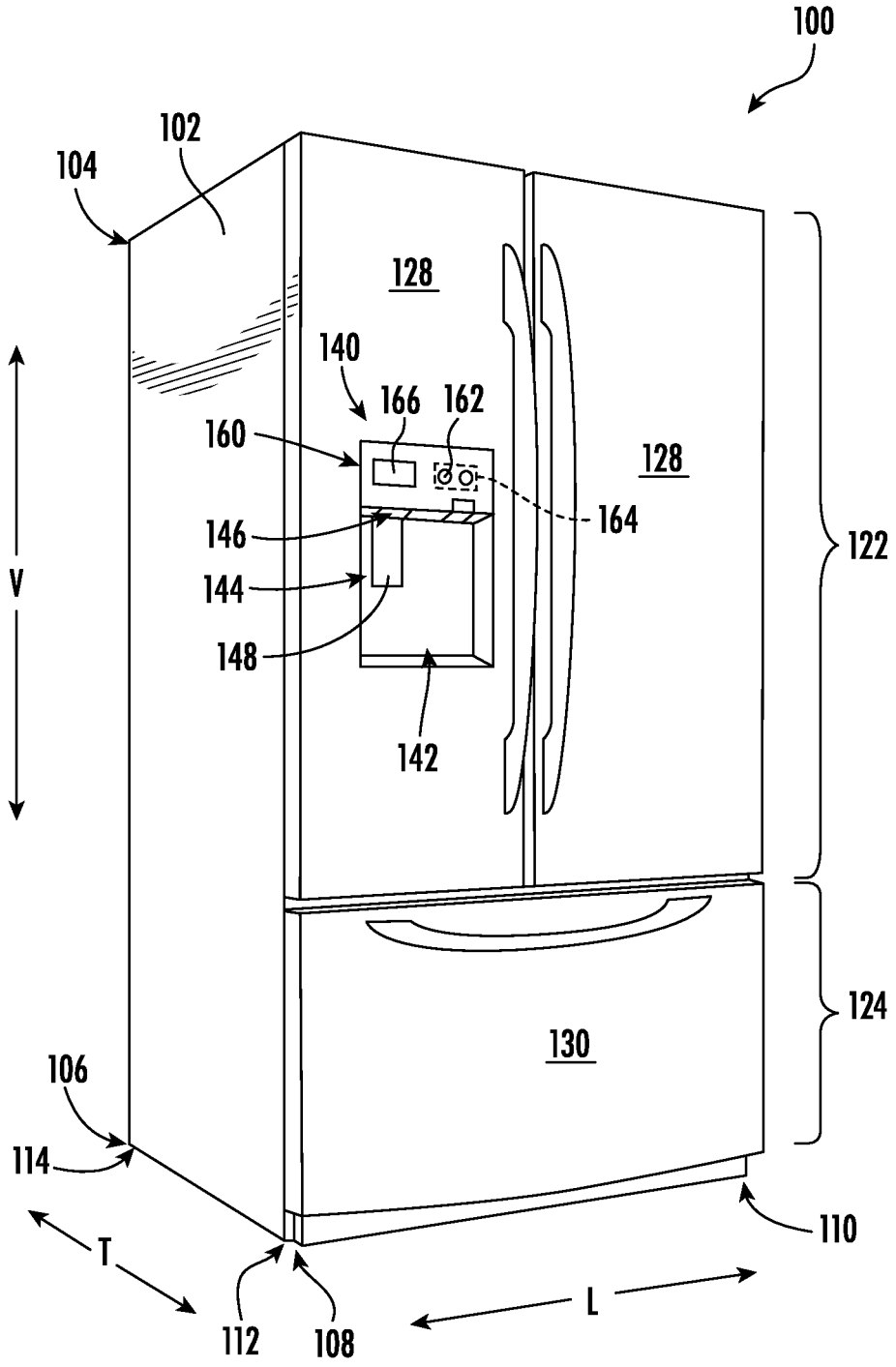
FIG. 1 provides a perspective view of a refrigerator appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view of a refrigerator appliance 100 according to an exemplary embodiment of the present disclosure. Refrigerator appliance 100 includes a cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Cabinet 102 defines chilled chambers for receipt of food items for storage. In particular, cabinet 102 defines fresh food chamber 122 positioned at or adjacent top 104 of cabinet 102 and a freezer chamber 124 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
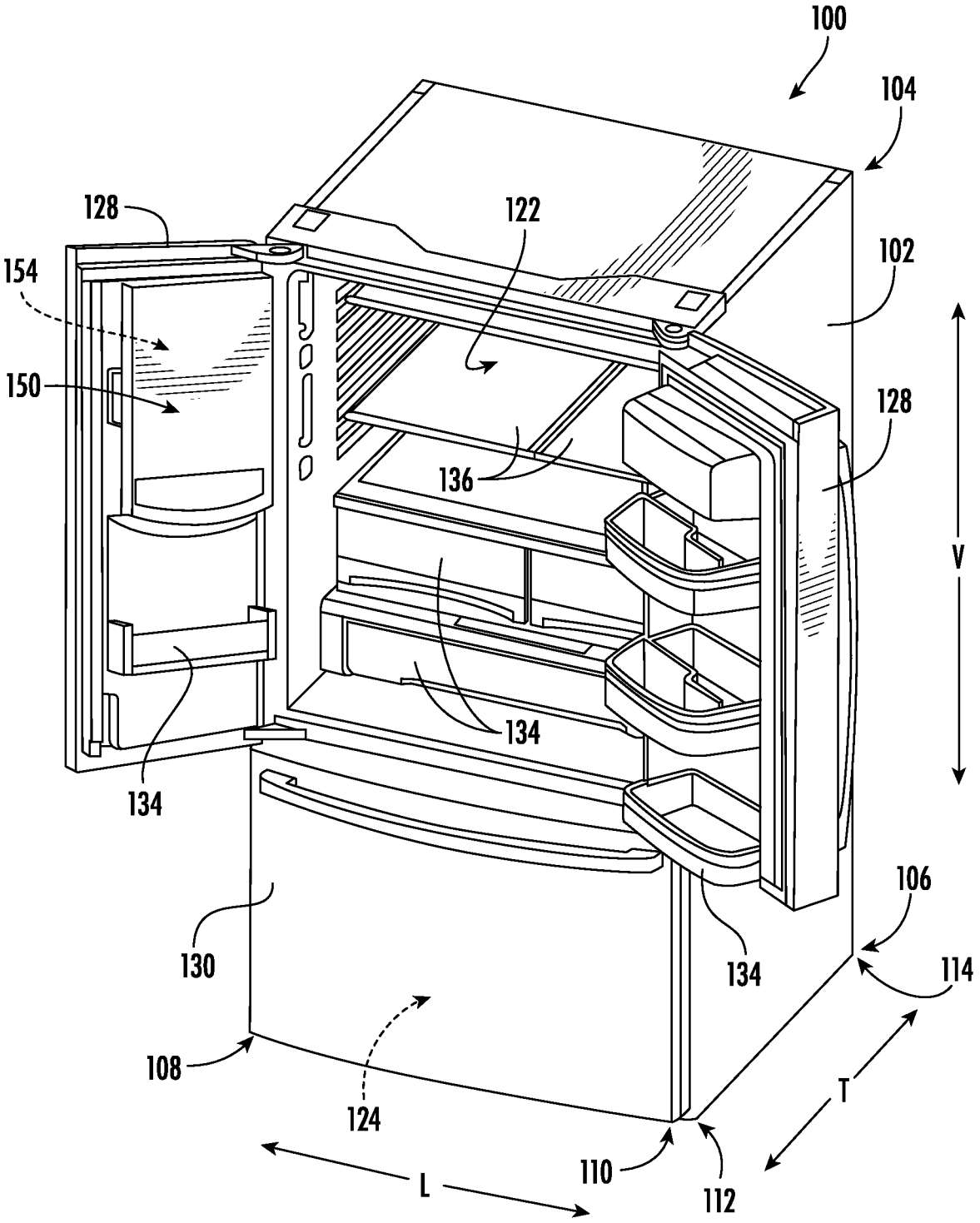
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present disclosure. Dispensing assembly 140 is generally configured for dispensing liquid water or ice. Although an exemplary dispensing assembly 140 is illustrated and described herein, it should be appreciated that variations and modifications may be made to dispensing assembly 140 while remaining within the present disclosure.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Figure 3:
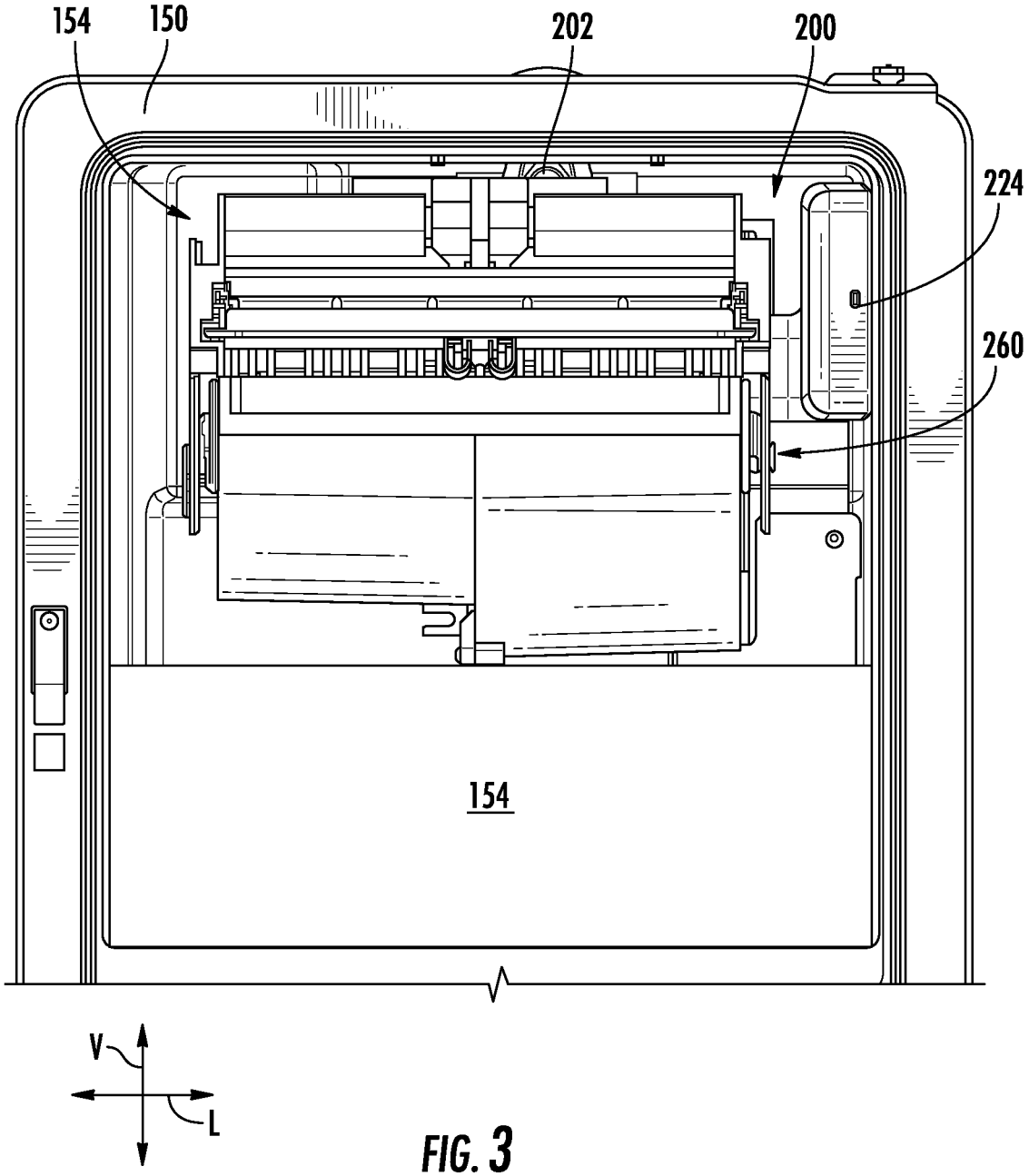
FIG. 3 provides a perspective view of an icebox and ice making assembly for use with the exemplary refrigerator appliance of FIG. 1 according to an exemplary embodiment of the present disclosure.
Figure 4:
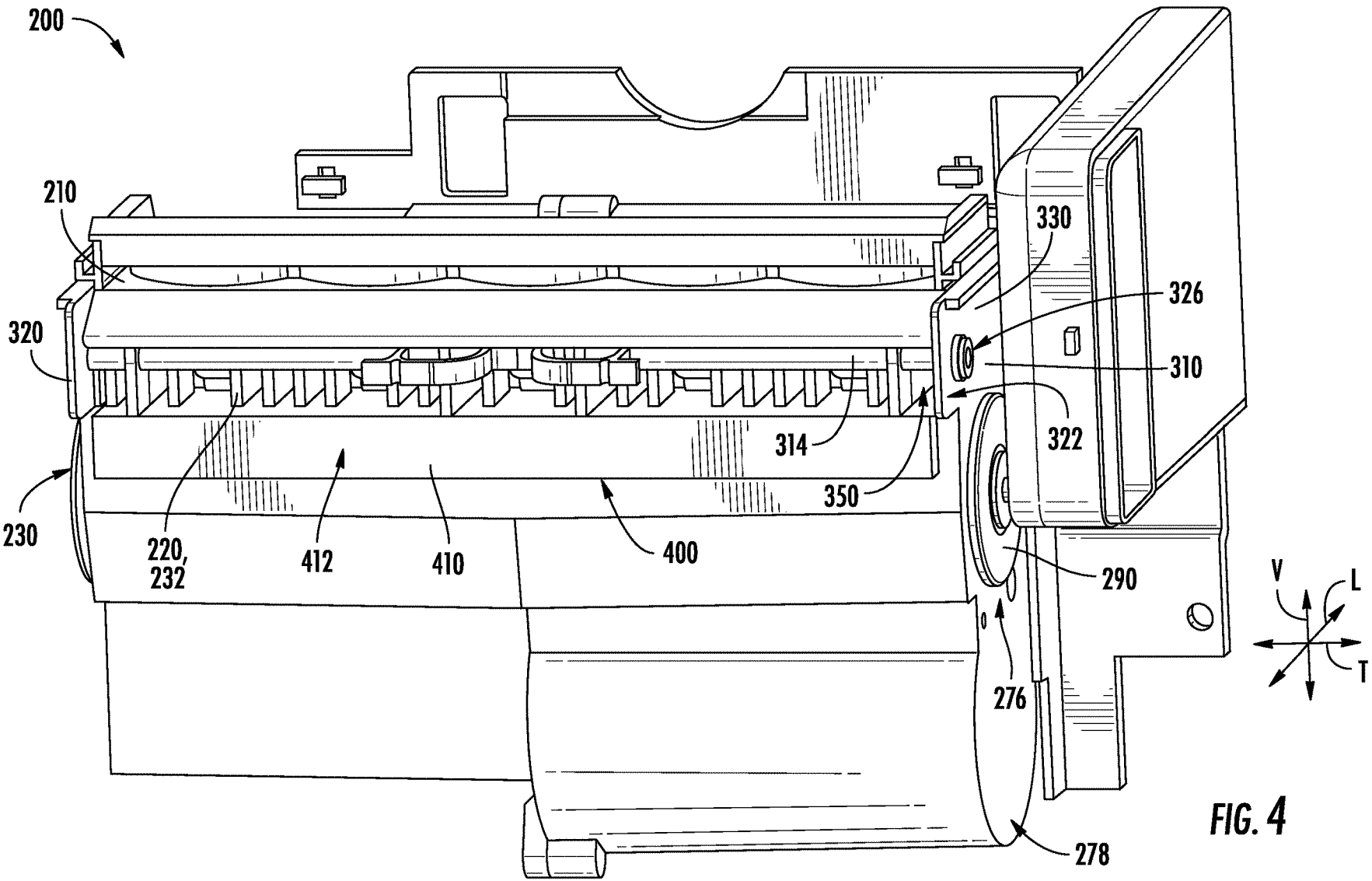
FIG. 4 provides a front perspective view of the exemplary ice making assembly of FIG. 3.
Figure 5:
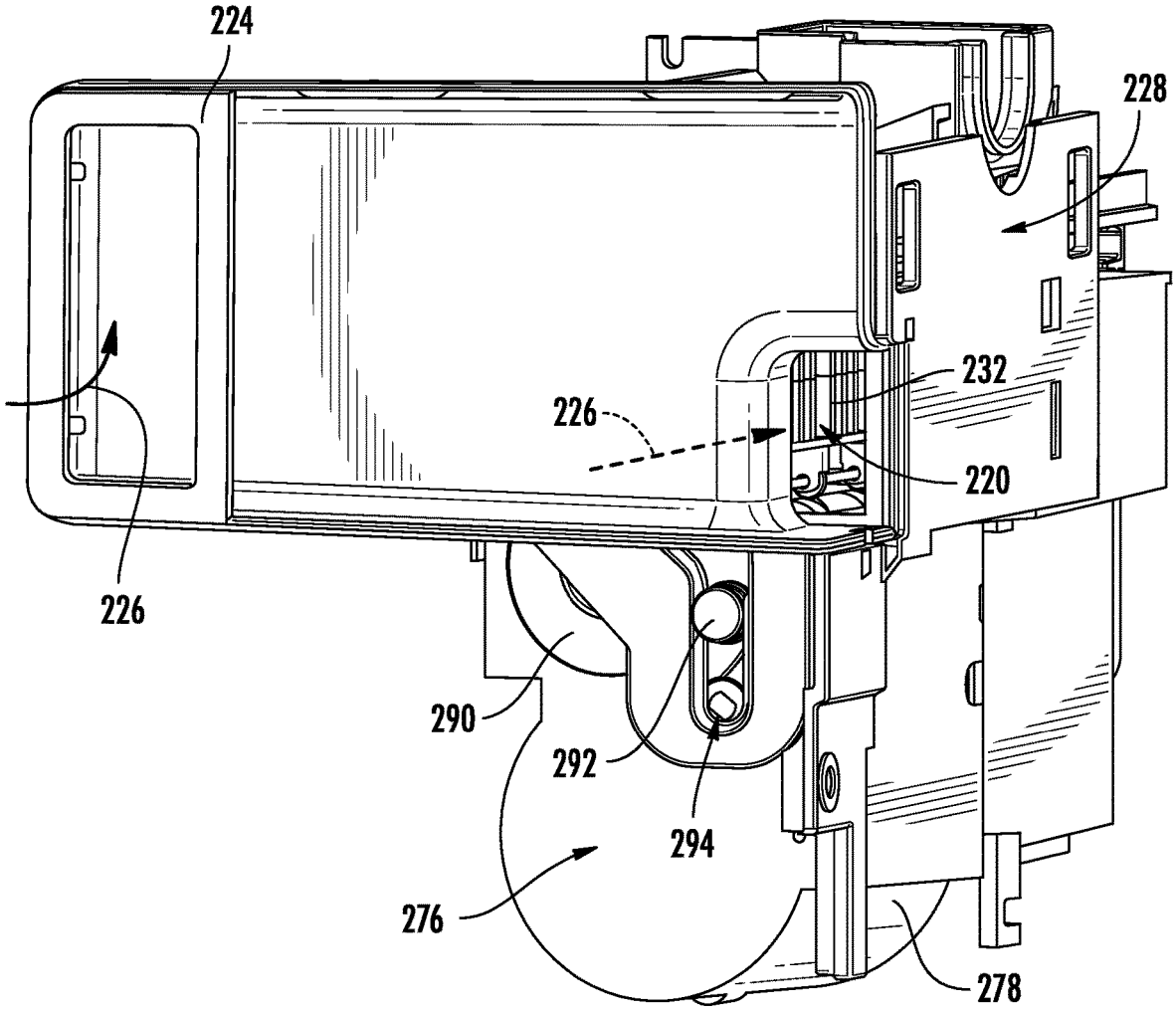
FIG. 5 provides a rear perspective view of the exemplary ice making assembly of FIG. 3.
Figure 6:
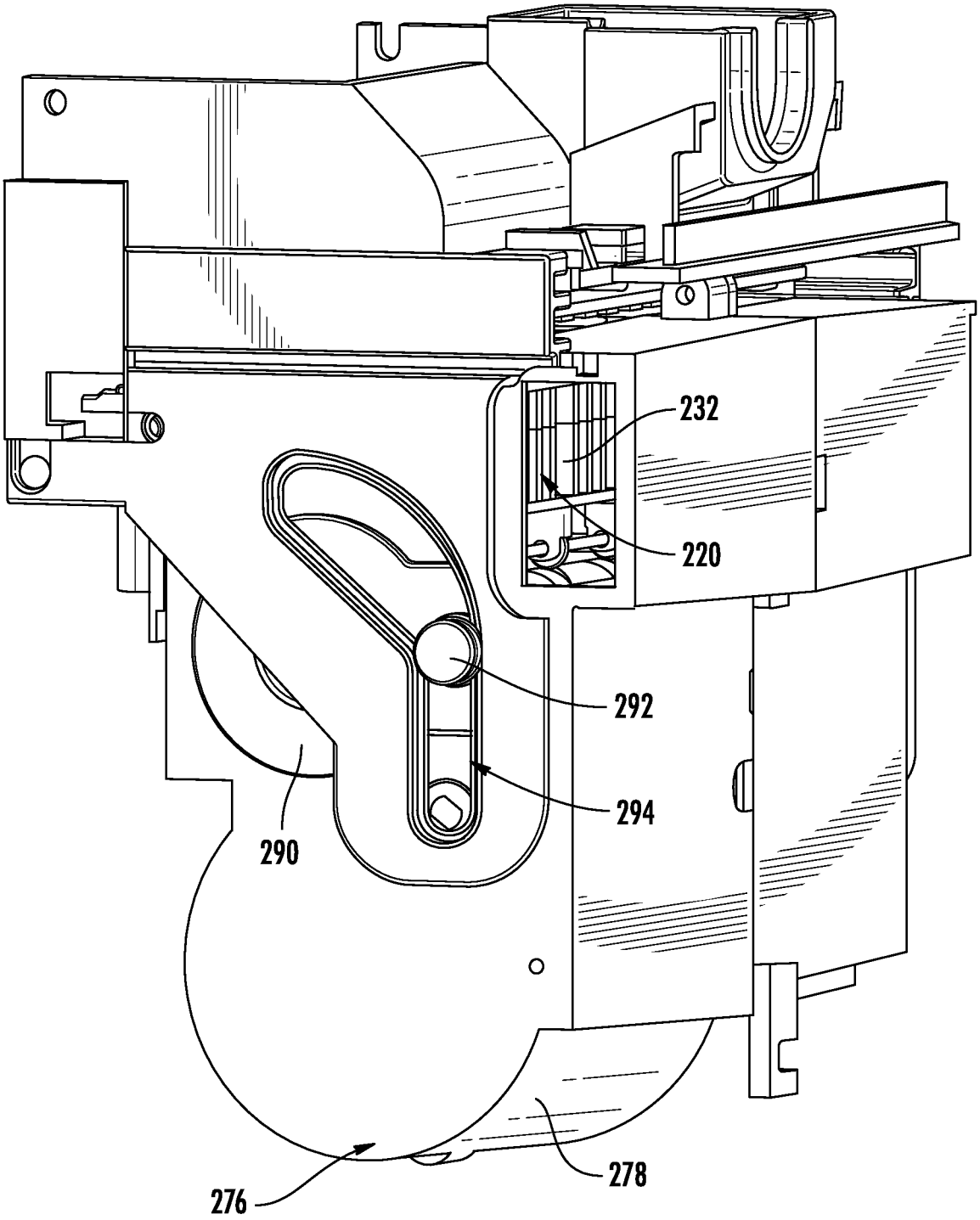
FIG. 6 provides a rear perspective view of a portion of the exemplary ice making assembly of FIG. 3, wherein an air duct has been removed for clarity.
Figure 7A:
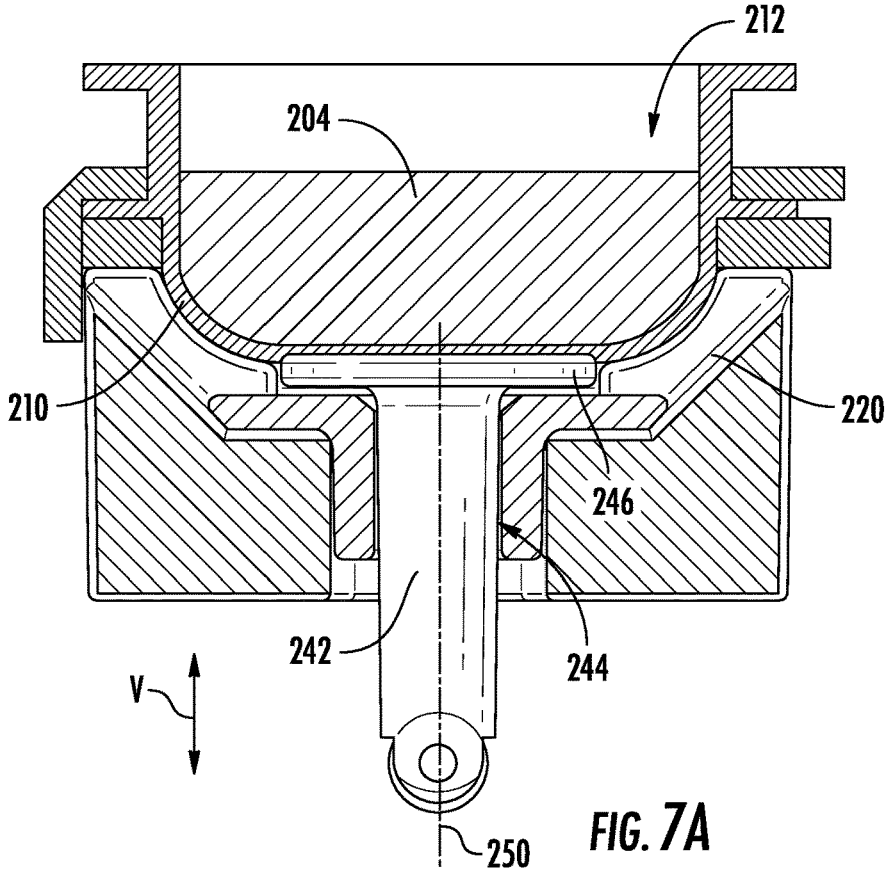
FIGS. 7A and 7B provide a side view of an ice mold between a lowered position and a raised position according to exemplary embodiments of the present disclosure.
Figure 7B:
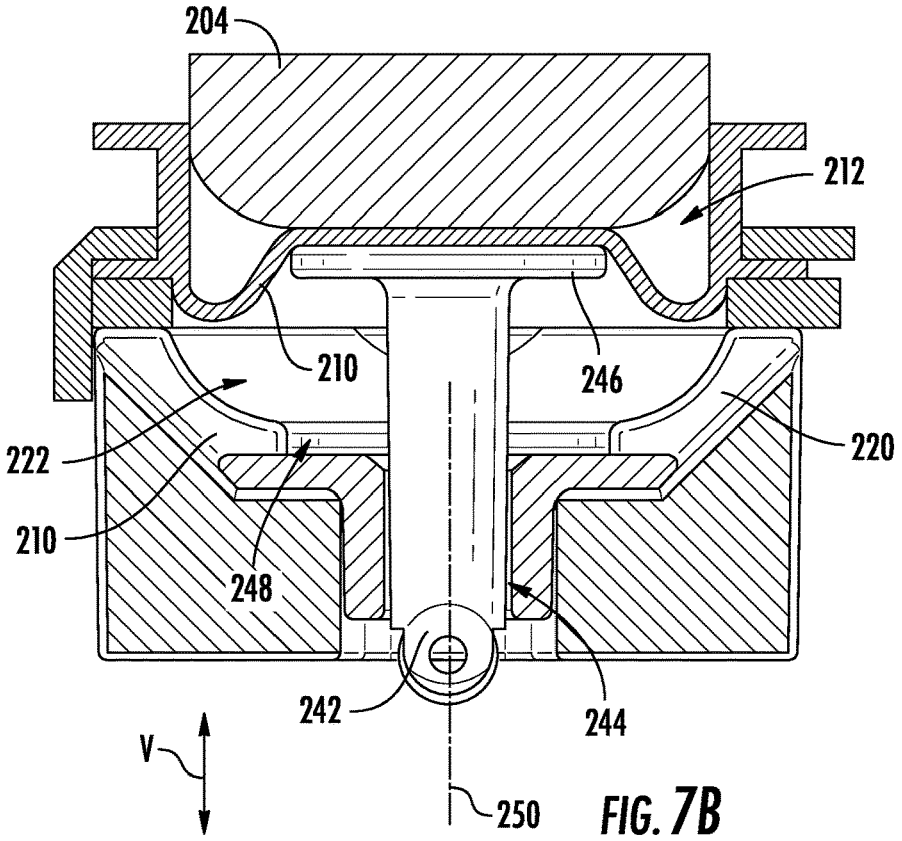
Figure 8A:
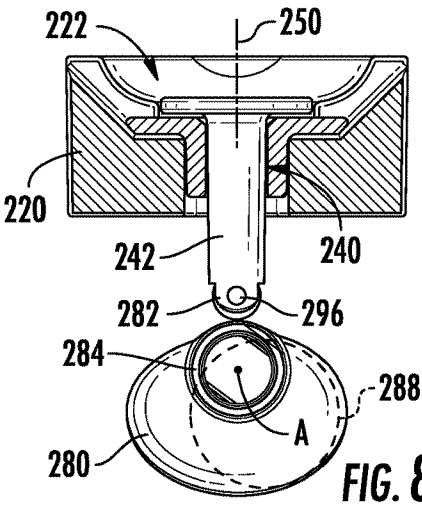
FIGS. 8A through 8H provide a side view of a cam lobe of a cam shaft of an ice making assembly over a set range of motion according to exemplary embodiments of the present disclosure.
Figure 8B:
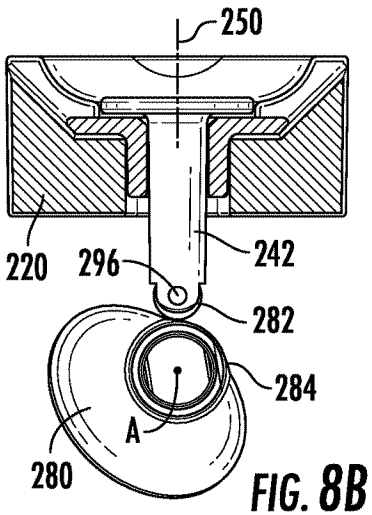
Figure 8C:
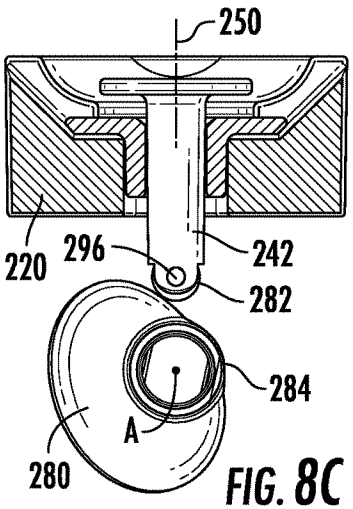
Figure 8D:
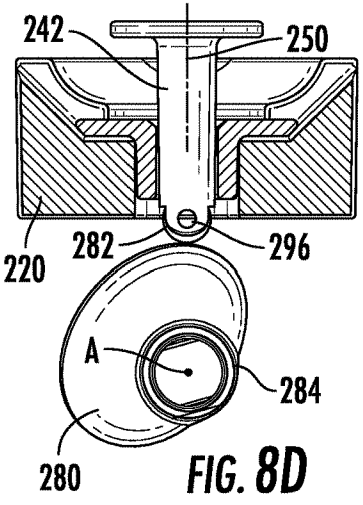
Figure 8E:
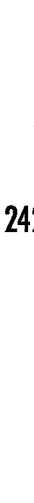
Figure 8F:
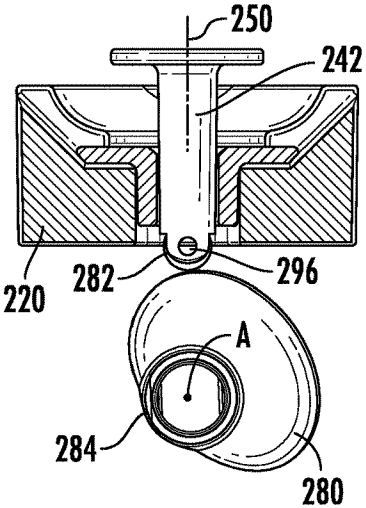
Figure 8G:
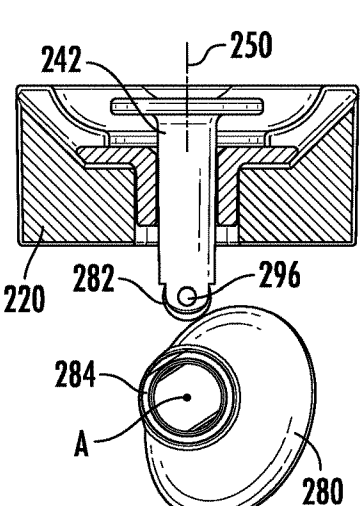
Figure 8H:
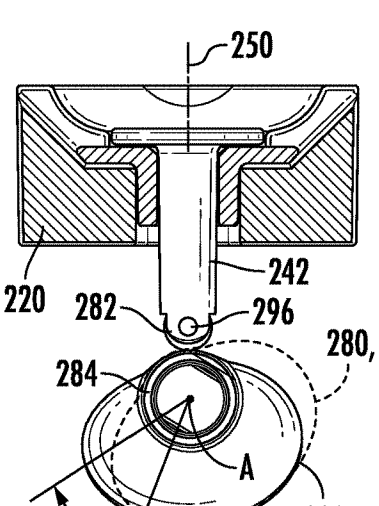
Figure 9:
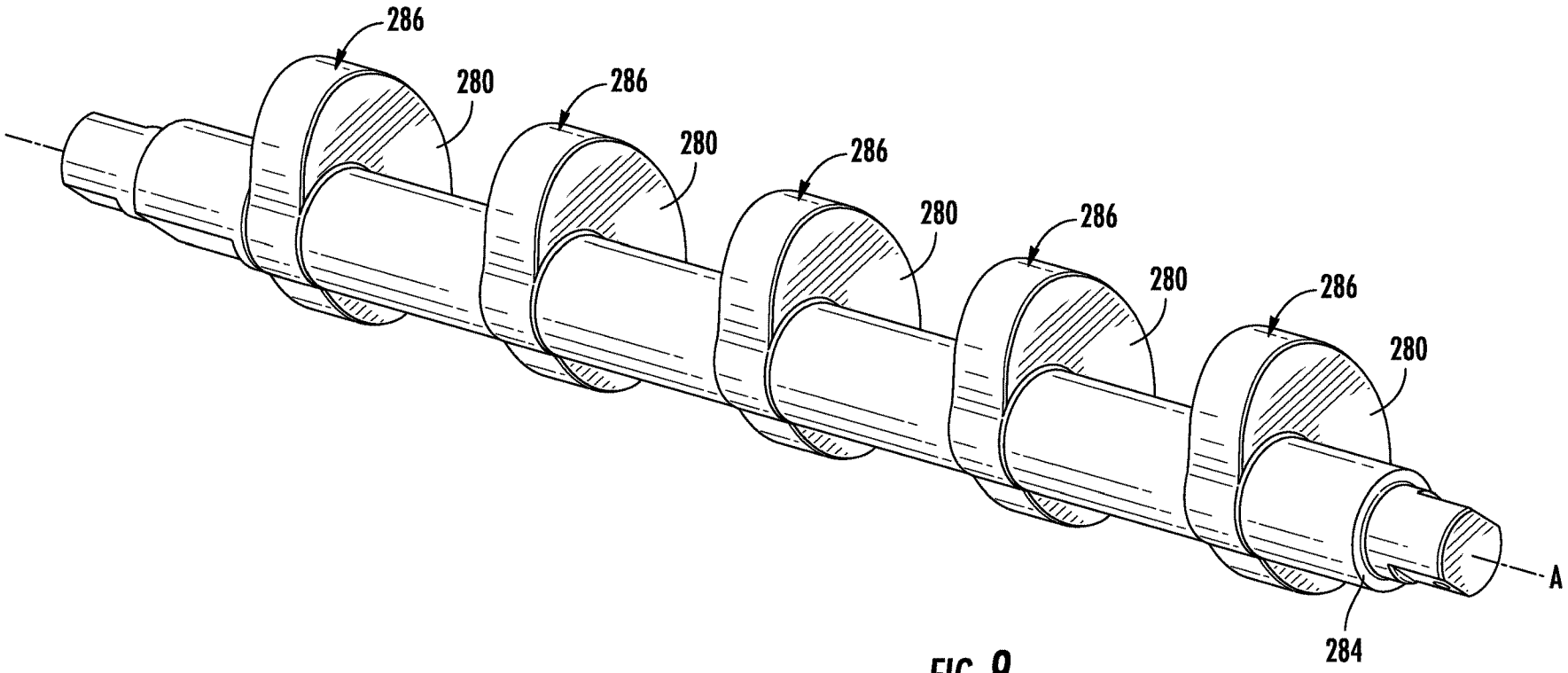
FIG. 9 provides a perspective view of a cam shaft of an ice making assembly according to exemplary embodiments of the present disclosure.
Figures 10A, 10B, 10C, 10D, 10E, 10F, 10G, 10H:
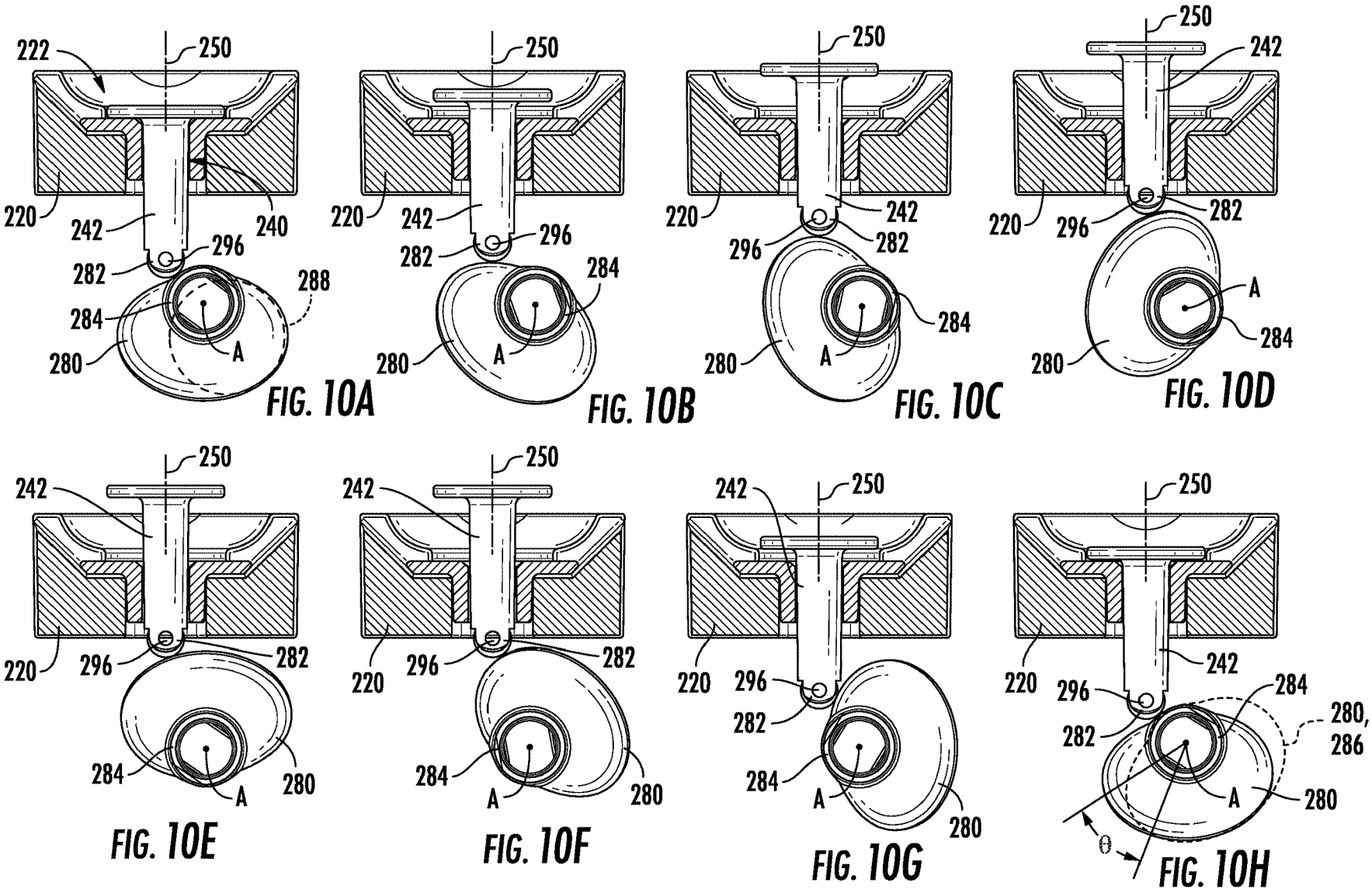
FIGS. 10A through 10H provide a side view of a cam lobe of a cam shaft of an ice making assembly over a set range of motion according to exemplary embodiments of the present disclosure.

By contrast, inside refrigerator appliance 100, refrigerator door 128 may define an icebox 150 (FIGS. 2 and 3) housing an icemaker and an ice storage bin 152 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions or data that when executed by the processing device, cause the processing device to perform operations.

Referring now generally to FIGS. 3 through 28, an ice making assembly 200 that may be used with refrigerator appliance 100 will be described according to exemplary embodiments of the present disclosure. As illustrated, ice making assembly 200 is mounted on icebox 150 within ice making chamber 154 and is configured for receiving a flow of water from a water supply spout 202. In this manner, ice making assembly 200 is generally configured for freezing the water to form ice cubes 204 which may be stored in storage bin 152 and dispensed through discharging outlet 146 by dispensing assembly 140. However, it should be appreciated that ice making assembly 200 is described herein only for the purpose of explaining aspects of the present disclosure. Variations and modifications may be made to ice making assembly 200 while remaining within the scope of the present disclosure. For example, ice making assembly 200 could instead be positioned within freezer chamber 124 of refrigerator appliance 100 and may have any other suitable configuration.

According to the illustrated embodiment, ice making assembly 200 includes an ice mold 210 that defines a mold cavity 212 (e.g., as a negative for the shape of an ice cube 204 to be formed or frozen). In general, ice mold 210 is positioned below water supply spout 202 for receiving the gravity-assisted flow of water from water supply spout 202. Optionally, ice mold 210 may be constructed as a resilient ice mold, which is formed from a suitably resilient material that may be deformed to release ice cubes 204 after formation. For example, according to the illustrated embodiment, ice mold 210 is formed from silicone or another suitable hydrophobic, food-grade, and resilient material.

According to the illustrated embodiment, ice mold 210 defines five mold cavities 212, each being shaped and oriented for forming a separate corresponding ice cube 204. In this regard, for example, water supply spout 202 is configured for refilling ice mold 210 to a level above a divider wall (not shown) within ice mold 210 such that the water overflows into the five mold cavities 212 evenly. According to still other embodiments, water supply spout 202 could have a dedicated discharge nozzle positioned over each mold cavity 212. Furthermore, it should be appreciated that according to alternative embodiments, ice making assembly 200 may be scaled to form any suitable number of ice cubes 204, e.g., by increasing or decreasing the number of mold cavities 212 defined by ice mold 210.

In certain embodiments, making assembly 200 further includes a heat exchanger 220 is in thermal communication with ice mold 210 for freezing the water within mold cavities 212 to form one or more ice cubes 204. In general, heat exchanger 220 may be formed from any suitable thermally conductive material and may be positioned in thermal communication (e.g., conductive thermal communication, such as by direct contact) with ice mold 210. In exemplary embodiments, heat exchanger 220 is formed from a conductive metal (e.g., comprising aluminum, including alloys thereof) and is positioned directly below ice mold 210. Furthermore, heat exchanger 220 may define a cube recess 222 which is configured to receive ice mold 210 and shape or define the bottom of ice cubes 204. In this manner, heat exchanger 220 is in direct contact with ice mold 210 over a large portion of the surface area of ice cubes 204, e.g., to facilitate quick freezing of the water stored within mold cavities 212. For example, heat exchanger 220 may contact ice mold 210 over greater than approximately half of the surface area of ice cubes 204.

In some embodiments, ice making assembly 200 includes an inlet air duct 224 that is positioned adjacent heat exchanger 220 and is fluidly coupled with a cool air supply (e.g., illustrated as a flow of cooling air 226). According to the illustrated embodiment, inlet air duct 224 provides the flow of cooling air 226 from a rear end 228 of ice making assembly 200 through heat exchanger 220 toward a front end 230 of ice making assembly 200 (e.g., to the left along the lateral direction L or the side where ice cubes 204 are discharged into storage bin 152).

As shown, inlet air duct 224 generally receives the flow of cooling air 226 from a sealed system of refrigerator appliance 100 and directs it over or through heat exchanger 220 (e.g., to cool heat exchanger 220). More specifically, according to the illustrated embodiment, heat exchanger 220 defines a plurality of heat exchange fins 232 that extend substantially parallel to the flow of cooling air 226. In this regard, heat exchange fins 232 extend down from a top of heat exchanger 220 along a plane defined by the vertical direction V in the lateral direction L (e.g., when ice making assembly 200 is installed in refrigerator appliance 100).

Referring especially to FIGS. 3 through 12, in some embodiments, ice making assembly 200 includes a lifter mechanism that is positioned below ice mold 210 and is generally configured for facilitating the ejection of ice cubes 204 from mold cavities 212 or recesses 222. In this regard, lifter mechanism is movable between a lowered position (e.g., as shown in FIG. 7A) and a raised position (e.g., as shown in FIG. 7B). For instance, lifter mechanism may include a lifter arm 242 that extends substantially along the vertical direction V. In some such embodiments, lifter arm 242 is disposed below the ice mold and movable relative to the mold cavity along a channel path between the lowered position and a raised position to raise ice cubes within the mold cavity. Optionally, the heat exchanger may define the corresponding lifter channel below the mold cavity along the channel path, and the lifter arm may through the lifter channel, as shown. In this manner, lifter channel 244 may guide lifter mechanism as it slides along the vertical direction V.

In addition, lifter mechanism comprises a lifter projection 246 that extends from a top of lifter arm 242 towards a rear end 228 of ice making assembly 200. As illustrated, lifter projection 246 generally defines the profile of the bottom of ice cubes 204 and is positioned flush within a lifter recess 248 defined by heat exchanger 220 when lifter mechanism is in the lowered position. In this manner, heat exchanger 220 and lifter projection 246 define a smooth bottom surface of ice cubes 204.

In optional embodiments, ice making assembly 200 further includes a sweep assembly 260 that is positioned over ice mold 210 and is generally configured for pushing ice cubes 204 out of mold cavities 212 and into storage bin 152 after they are formed. Specifically, according to the illustrated embodiment, sweep assembly 260 is movable along the horizontal direction (i.e., as defined by the lateral direction L and the transverse direction T) between a retracted position and an extended position.

In some such embodiments, sweep assembly 260 remains in the retracted position while water is added to ice mold 210, throughout the entire freezing process, and as lifter mechanism is moved towards the raised position. After ice cubes 204 are in the raised position, sweep assembly 260 moves horizontally from the retracted to the extended position, i.e., toward front end 230 of ice making assembly 200. In this manner, sweep assembly pushes ice cubes 204 off of lifter mechanism, out of ice mold 210, and over a top of heat exchanger 220 where they may fall into storage bin 152.

Notably, dispensing ice cubes 204 from the top of ice making assembly 200 permits a taller storage bin 152, and thus a larger ice storage capacity relative to ice making machines that dispense ice from a bottom of the icemaker. According to the illustrated embodiment, water supply spout 202 is positioned above ice mold 210 for providing the flow of water into ice mold 210. In addition, water supply spout 202 is positioned above sweep assembly 260 such that sweep assembly 260 may move between the retracted position and an extended position without contacting water supply spout 202. According to alternative embodiments, water supply spout 202 may be coupled to a mechanical actuator that lowers water supply spout 202 close to ice mold 210 while sweep assembly 260 is in the retracted position. In this manner, the overall height or profile of ice making assembly 200 may be further reduced, thereby maximizing ice storage capacity and minimizing wasted space.

According to the illustrated embodiment, sweep assembly 260 may include one or more vertically extending side arms that are used to drive a raised frame that is positioned over top of ice mold 210. Specifically, the raised frame extends around ice mold 210 prevents splashing of water within ice mold 210. This is particularly important when ice making assembly 200 is mounted on refrigerator door 128 because movement of refrigerator door 128 may cause sloshing of water within mold cavities 212.

Generally, ice making assembly 200 may include a drive mechanism 276 that is operably coupled to lifter mechanism to selectively raise lifter mechanism. Additionally or alternatively, drive mechanism 276 is operably coupled to sweep assembly 260 to selectively slide sweep assembly 260 to discharge ice cubes 204 during operation. Specifically, according to the illustrated embodiment, drive mechanism 276 comprises a drive motor 278. As used herein, "motor" may refer to any suitable drive motor or transmission assembly for rotating a system component. For example, motor 278 may be a brushless DC electric motor, a stepper motor, or any other suitable type or configuration of motor. Alternatively, for example, motor 278 may be an AC motor, an induction motor, a permanent magnet synchronous motor, or any other suitable type of AC motor. In addition, motor 278 may include any suitable transmission assemblies, clutch mechanisms, or other components.

As shown, motor 278 may be mechanically coupled to a cam shaft 284 that includes one or more rotating cam lobes 280 to rotate about a set cam axis A. When assembled, cam axis A may be, for instance, parallel to horizontal direction (e.g., transverse direction T). Additionally or alternatively, cam shaft 284 may be disposed below the heat exchanger 220 or mold cavities 212. Thus, the cam lobes 280, and cam shaft 284 generally, may rotate below the heat exchanger 220 about the cam axis A.

As shown, cam lobe 280 generally defines a cam profile 286, which may form a semi-elliptical two-dimensional shape (e.g., perpendicular to the cam axis A). For instance, one or more cam lobes 280 may have a cam profile 286 that is an egg-shaped, oval, or elliptical profile. Moreover, cam profile 286 may be least partially defined along a base circle 288 (e.g., the smallest circle that can be drawn to the cam profile 286). In turn, the cam axis A may be eccentrically defined relative to the base circle 288.

As shown, for instance in FIGS. 8A through 8H, lifter mechanism, or more specifically lifter arm 242, may ride against rotating cam 280 such that the profile of rotating cam 280 causes lifter mechanism move between the lowered position and the raised position as motor 278 rotates rotating cam 280 about the cam axis A.

When assembled, cam shaft 284 is generally disposed below mold cavity 212 or recess 222 such that the rotating cam lobes 280 are able to direct reciprocation of one or more lifter arms 242, such as within their corresponding channel paths 250. In certain embodiments, such as those illustrated in FIGS. 8A through 8H, the cam shaft 284, and particularly the cam axis A is vertically aligned with the channel paths 250. Thus, cam axis A may extend axially directly beneath the channel paths 250. Nonetheless, in alternative embodiments, such as those illustrated in FIGS. 10A through 10H, the cam shaft 284 may be rotatable about a cam axis A horizontally (e.g., transversely) offset from the channel paths 250. In turn, a relatively slow "ascent face" and a relatively fast "descent face" may be defined. As a cam lobe 280 raises a corresponding lifter arm 242 for the initial—and typically most demanding-portion of the reciprocation movement of the lifter arm 242 (e.g., FIGS. 10B and 10C) or ice cube, almost all of the force applied from the cam lobe 280 is advantageously applied vertically. Although, the cam and lifter arm 242 may be out of alignment during the return portion of the reciprocation movement, such misalignments are negligible to the motor since there is relatively little force being applied at the return portion of the reciprocation movement of cam lobe 280.

In certain embodiments, a wheel roller 282 is rotatably mounted to the lifter arm 242 (e.g., at the lower end thereof) in contact with the corresponding cam lobe 280 to provide a low friction interface between lifter mechanism and rotating cam 280. As shown, the wheel roller 282 may define roller axle 296 about which the wheel roller 282 rotates. Moreover, the roller axis may be vertically aligned with the channel path 250 and perpendicular thereto such that wheel roller 282 rolls in tandem with and parallel to the cam shaft 284.

Returning generally to FIGS. 3 through 12, a plurality of lifter mechanisms and corresponding cam lobes 280 may be provided. As shown, each of the lifter arm 242 may be positioned below a corresponding mold cavity 212 or recess 222 (i.e., and any ice cubes 204 within ice mold 210). Each lifter arm 242 may be configured to raise a separate portion of ice mold 210. As motor 278 rotates cam shaft 284, cam lobes 280 may simultaneously move lifter arms 242 along the vertical direction V. In this manner, each of the plurality of cam lobes 280 may be configured for driving a respective one lifter mechanism. Optionally, a roller axle 296 (e.g., single roller axle) may extend between multiple wheel rollers 282 of adjacent lifter arm 242 to maintain a proper distance between adjacent rollers 282 and to keep them engaged on top of cam lobes 280.

In some embodiments, two or more of the cam lobes 280 (i.e., at least a first cam lobe 280 and a second cam lobe 280) are circumferentially offset. For instance, using FIGS. 8H and 10H as a reference, a second cam lobe 280 may be in the position illustrated in dashed lines at the same moment that a first cam lobe 280 is in the position illustrated in solid lines in FIG. 8H or 10H8B. Optionally, each of the cam lobes 280 may be circumferentially offset by a set angle θ (e.g., between 1° and 100 about the cam axis A). For instance, the same set angle θ may be provided as a predetermined lobe separation angle separating each adjacent cam lobe 280 from the other (e.g., adjacent along the axial direction of the cam axis A). During use, the circumferential offset may stagger movement (e.g., reciprocation along a corresponding channel path 250) of the corresponding lifter arms 242. Notably, torque demands on the cam shaft 284 or motor 278 for lifting ice cubes 204 may be reduced (e.g., in comparison to a non-offset configuration). Additionally or alternatively, each of the lifter arms 242 may be identical, notably ensuring easy or robust assembly.

Figure 11:
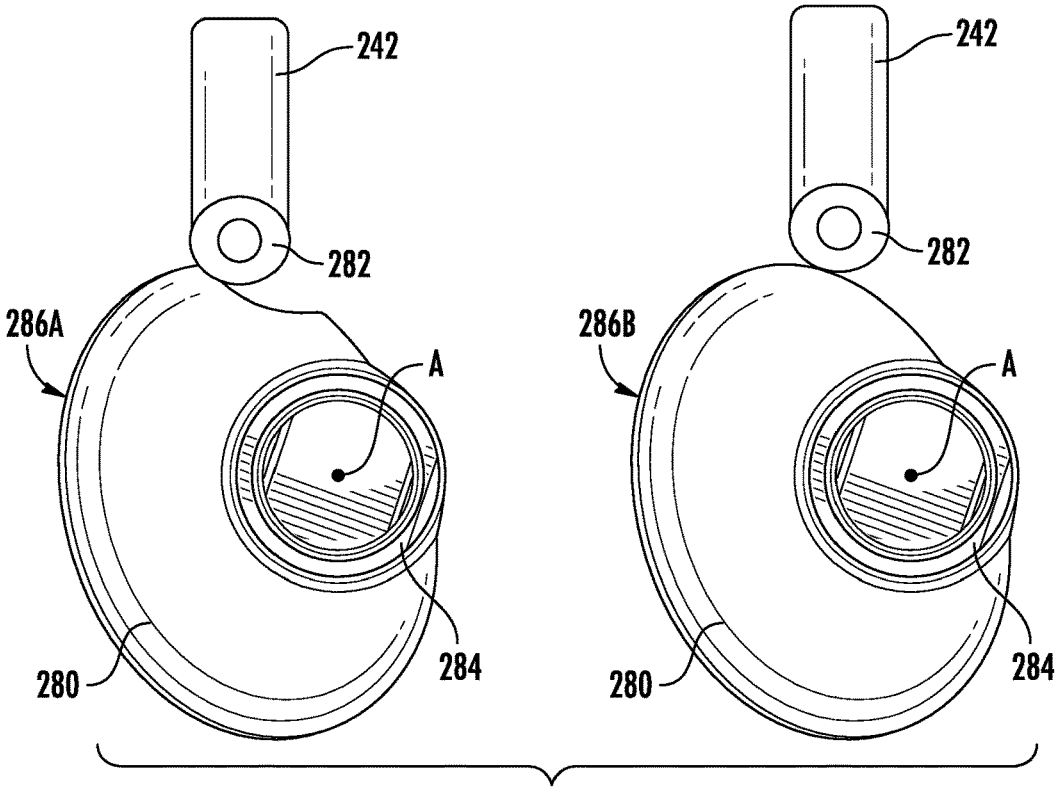
FIG. 11 provides a side view of a pair of lifter arms and cam lobes of a cam shaft of an ice making assembly according to exemplary embodiments of the present disclosure.

Turning briefly to FIG. 11, separate from or in addition to the above-described embodiments, two or more of the cam lobes 280 may define a distinct or non-identical profile. In other words, a first cam profile 286A that is defined by a first cam lobe 280 may be non-identical to a second cam profile 286B defined by a second cam lobe 280. For instance, the first cam lobe 280 may define a recessed scallop proximal or tangent to an apex of the first cam profile 286A. Notably, a slight delay may be provided in the lifting or ejection of a portion of the ice cubes. In some such embodiments, the two or more cam lobes 280 may share a common base circle 288 (see e.g., FIG. 8A).

Figure 12:
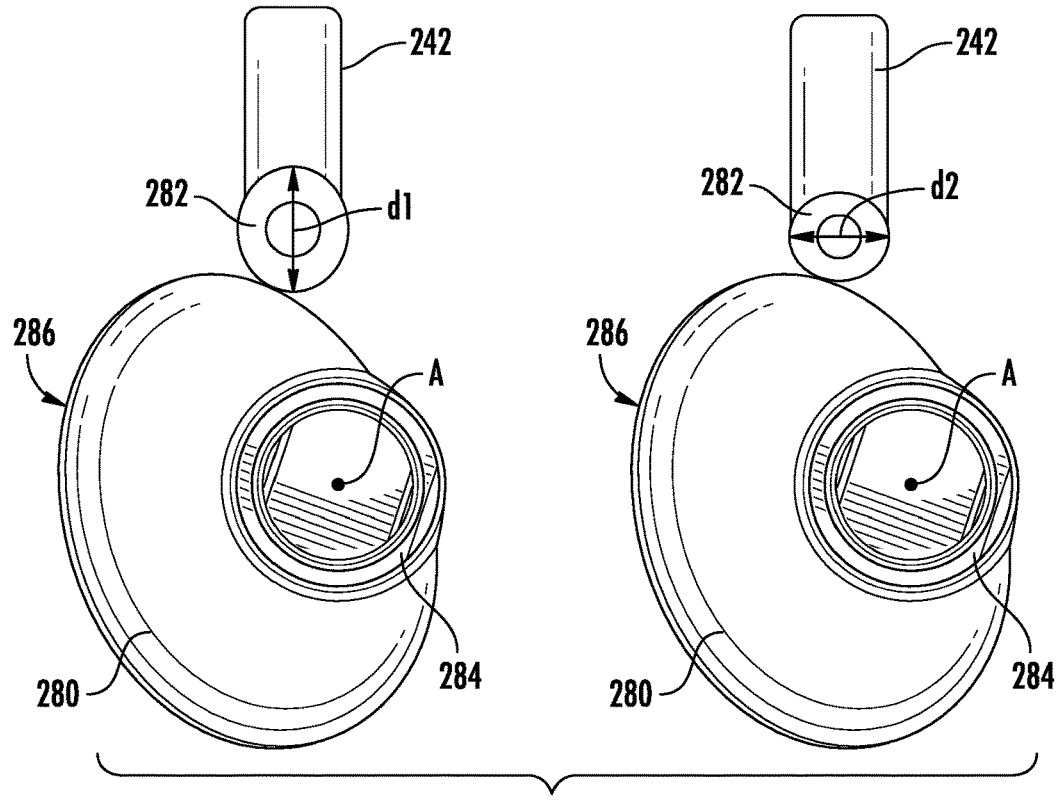
FIG. 12 provides a side view of a pair of lifter arms and cam lobes of a cam shaft of an ice making assembly according to exemplary embodiments of the present disclosure.
Figure 13:
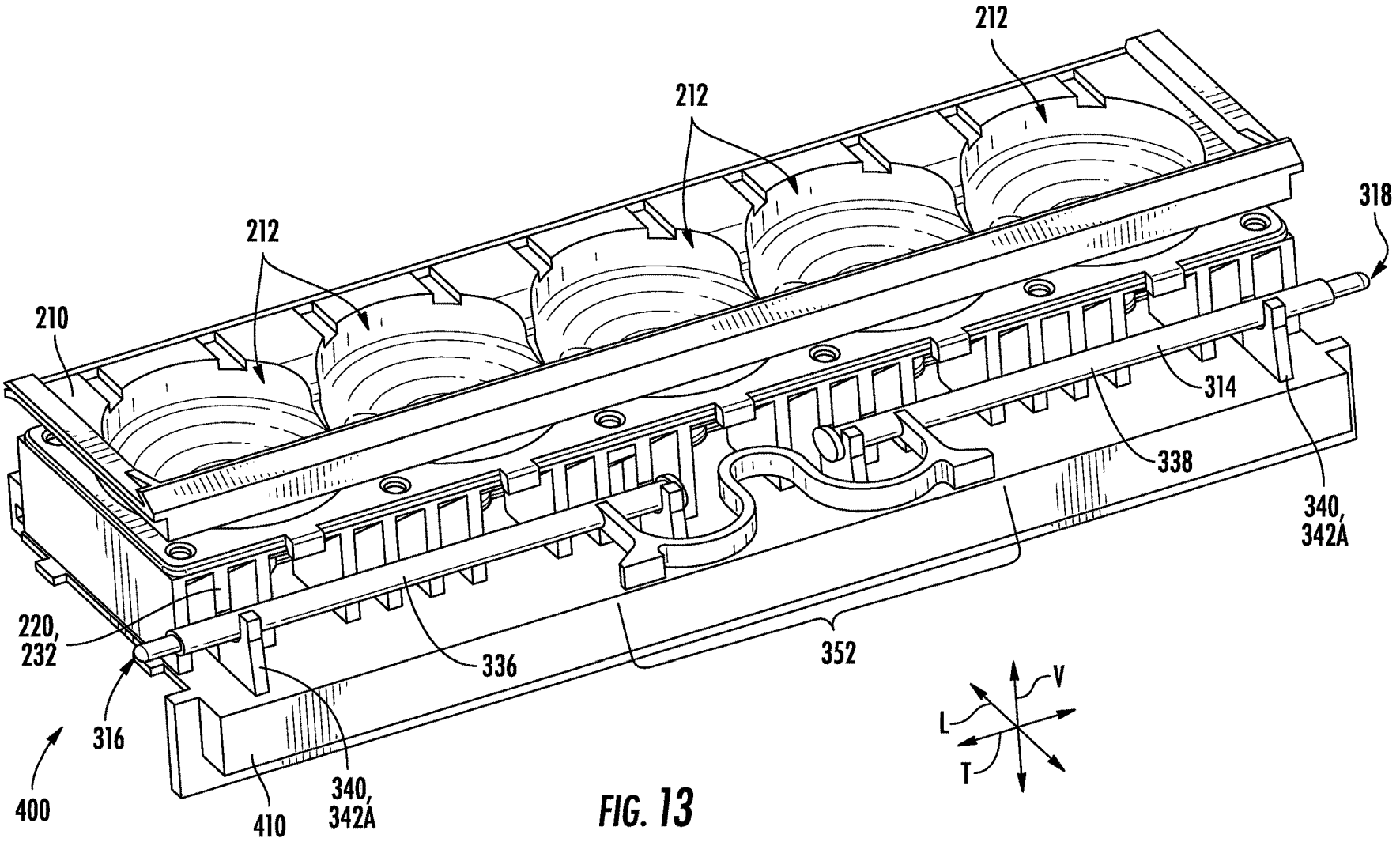
FIG. 13 provides a perspective view of a portion of the exemplary ice making assembly of FIG. 4.
Figure 14:
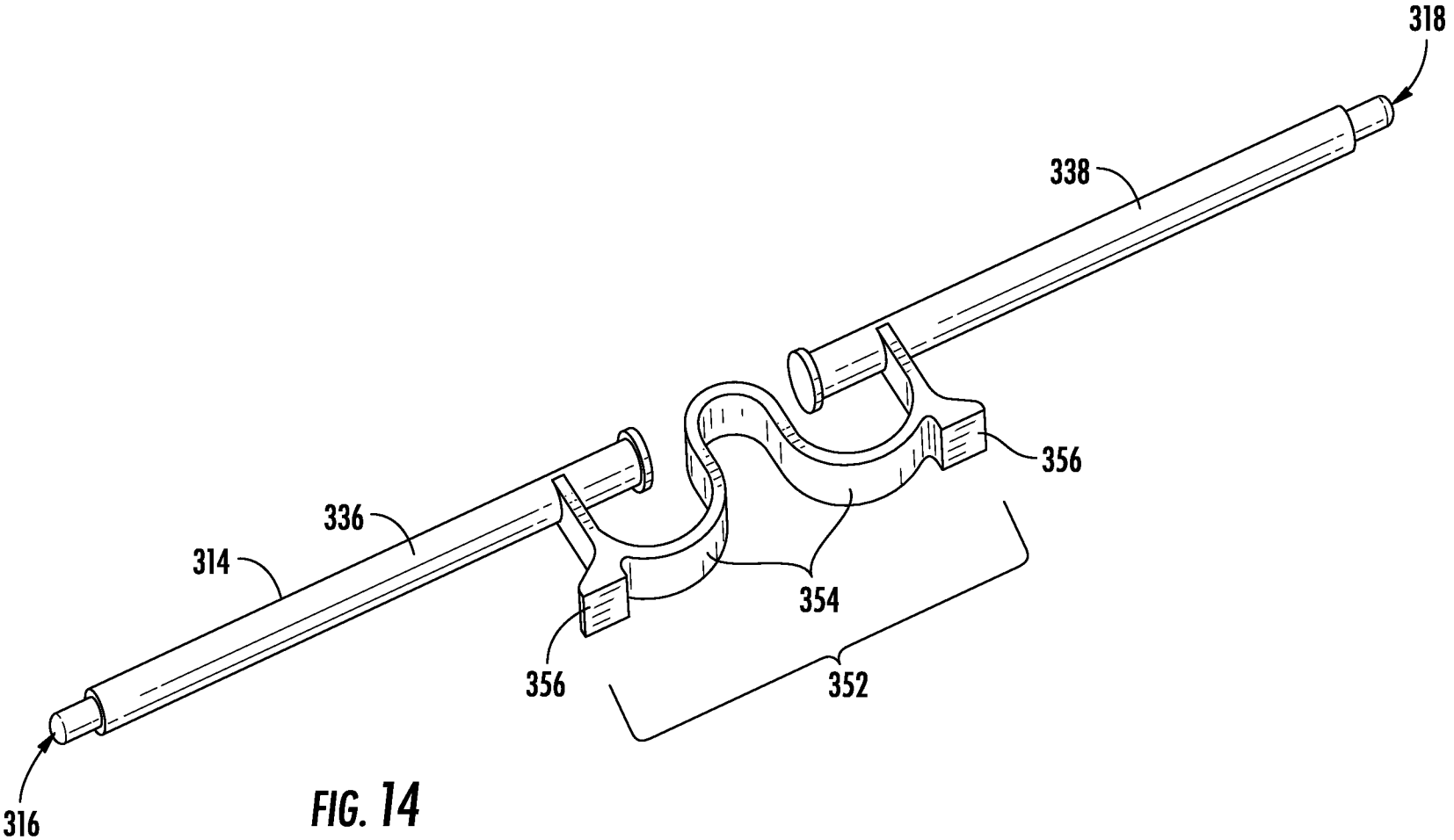
FIG. 14 provides a perspective view of a latch bar of the exemplary ice making assembly of FIG. 4.
Figure 15:
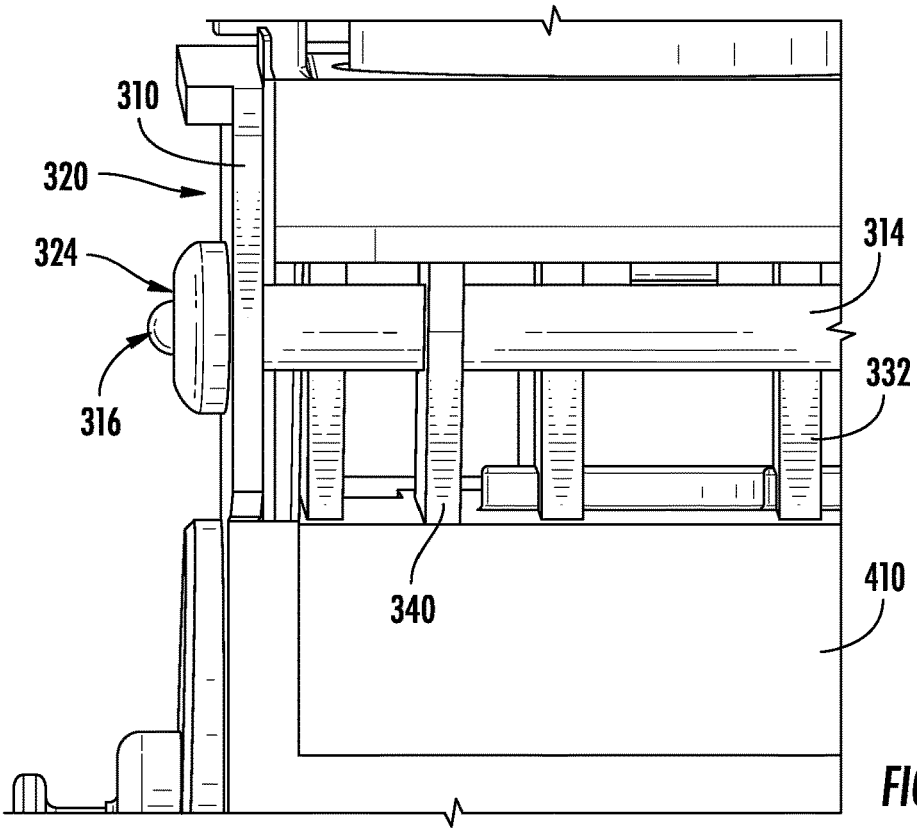
FIG. 15 provides a magnified perspective view of a left portion of the exemplary ice making assembly of FIG. 4.
Figure 16:
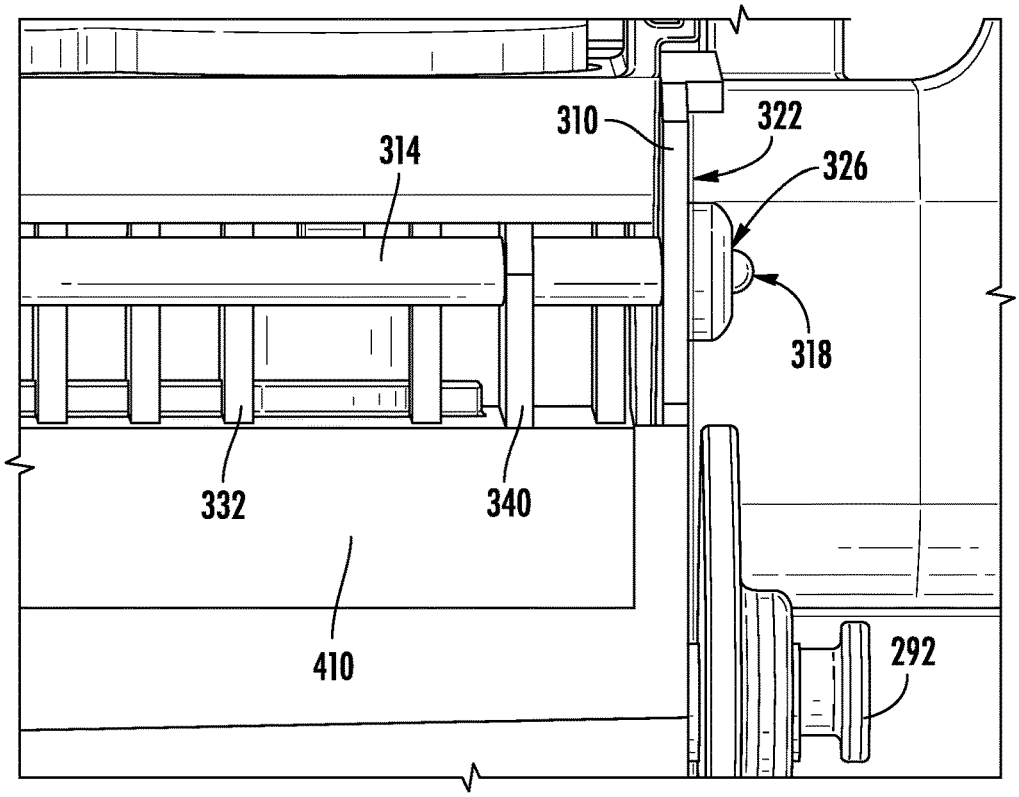
FIG. 16 provides a magnified perspective view of a right portion of the exemplary ice making assembly of FIG. 4.
Figure 17:
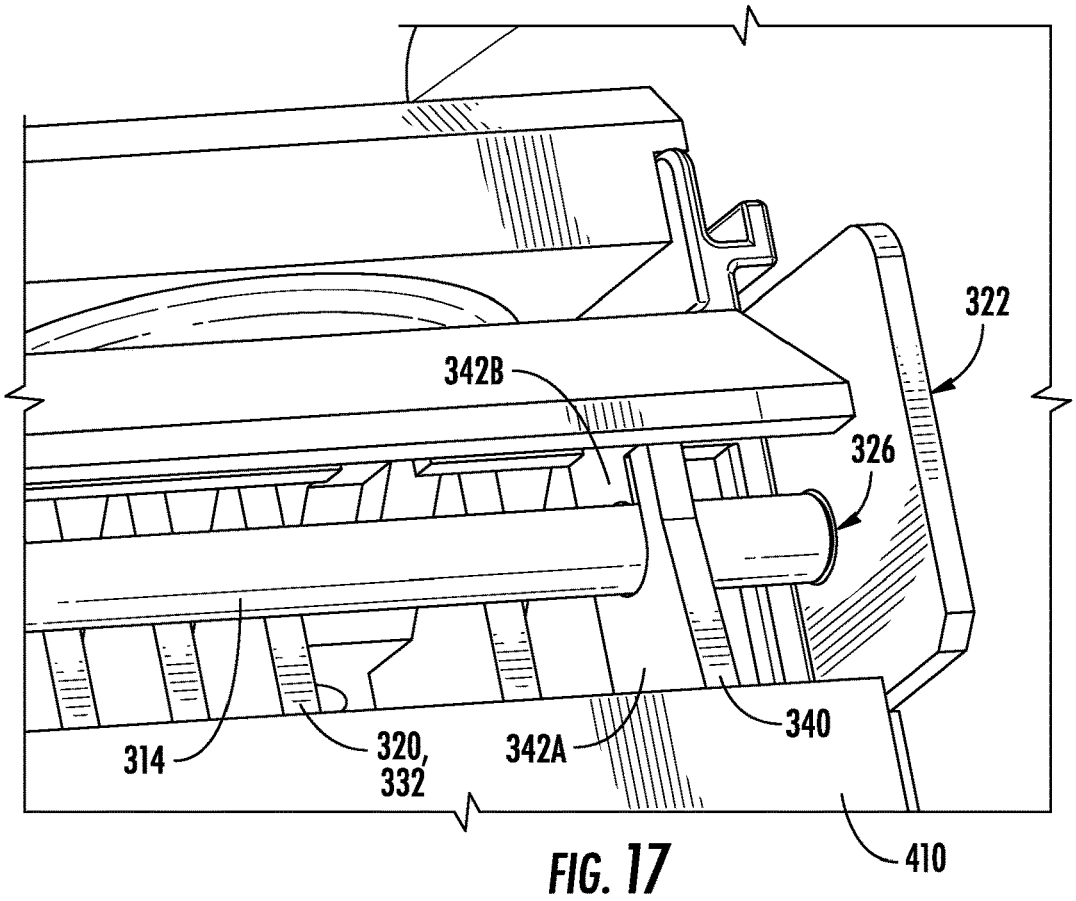
FIG. 17 provides a magnified bottom perspective view of a right portion of the exemplary ice making assembly of FIG. 4.
Figure 18:
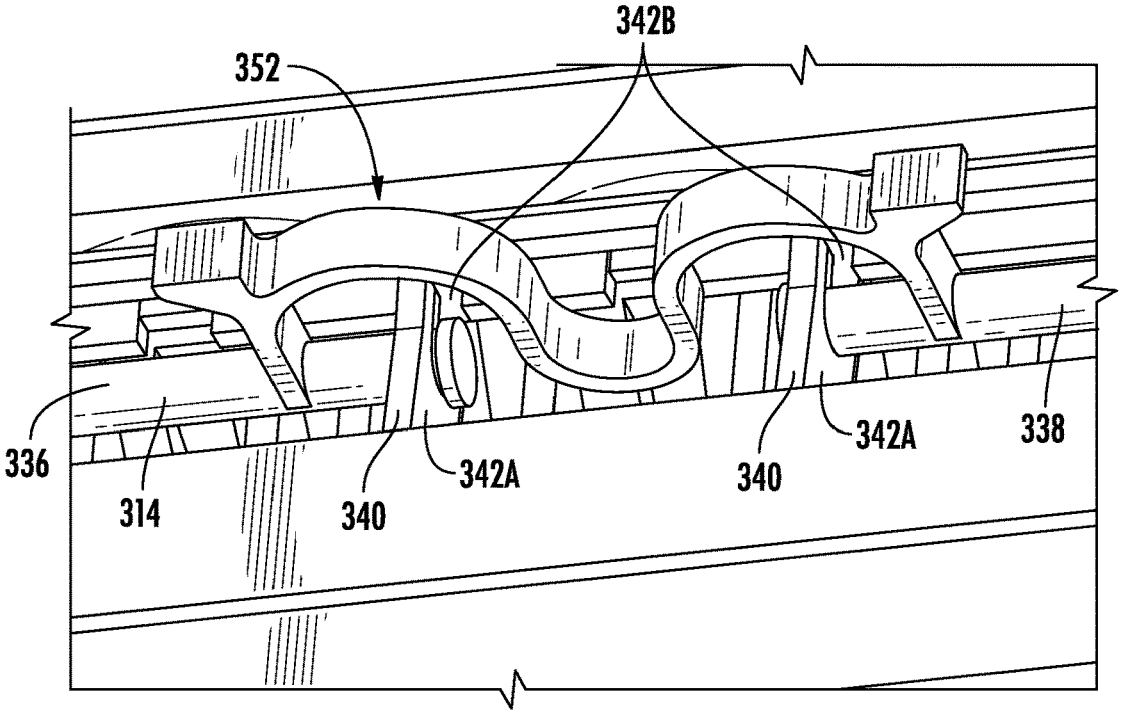
FIG. 18 provides a magnified bottom perspective view of a middle portion of the exemplary ice making assembly of FIG. 4.
Figure 19:
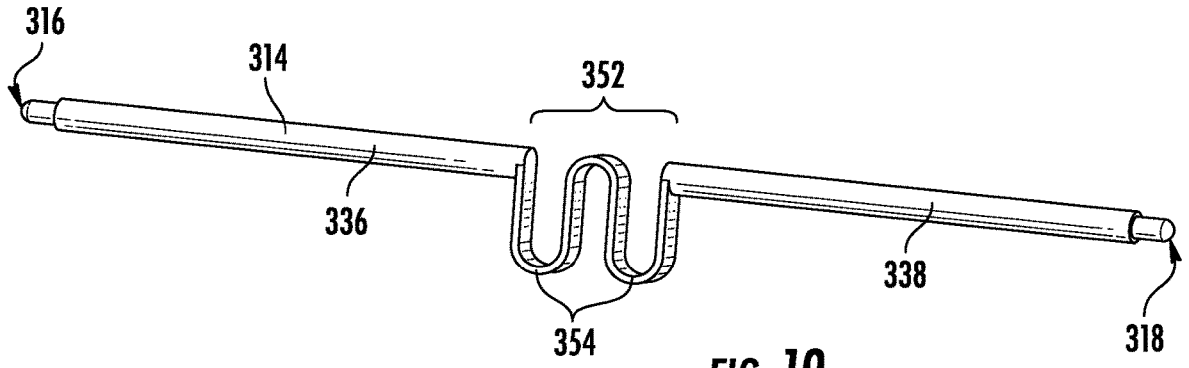
FIG. 19 provides a perspective view of a latch bar of an ice making assembly according to exemplary embodiments of the present disclosure.
Figure 20:
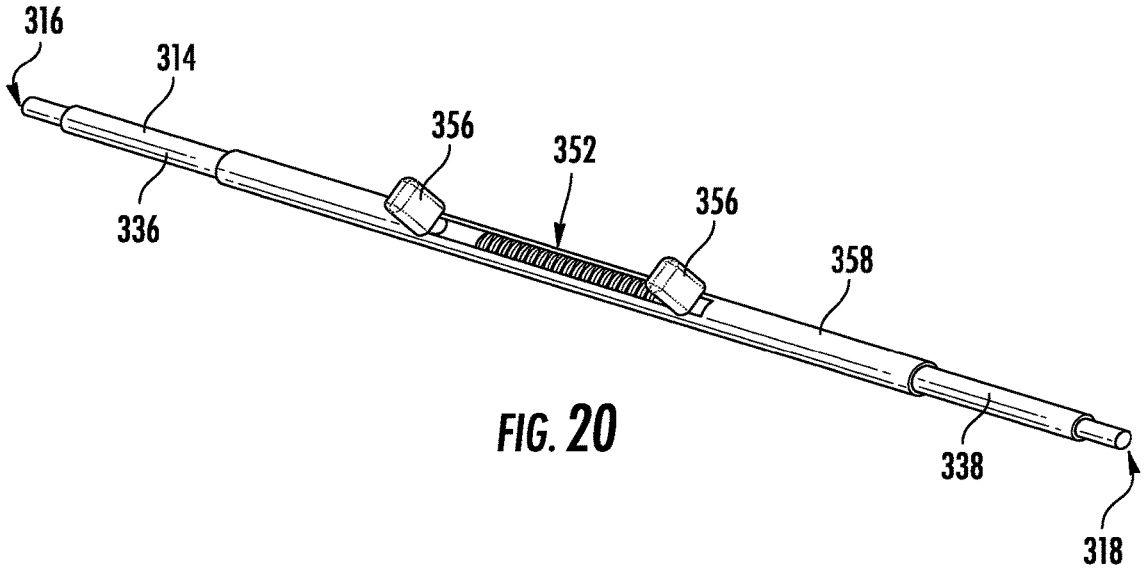
FIG. 20 provides a perspective view of a latch bar of an ice making assembly according to exemplary embodiments of the present disclosure.
Figure 21:
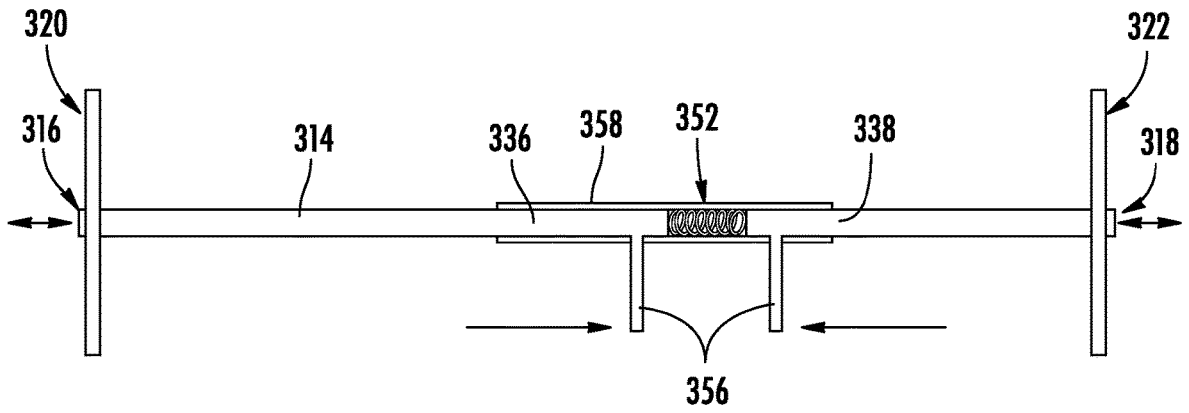
FIG. 21 provides a schematic section view of a latch bar of an ice making assembly according to exemplary embodiments of the present disclosure.

Turning briefly to FIG. 12, separate from or in addition to the above-described embodiments, two or more of the wheel rollers 282 may define distinct or non-identical diameters (e.g., perpendicular to the axle 296). In other words, a first roller diameter d1 that is defined by a first wheel roller 282 may be different from (e.g., less than) a second roller diameter d2 defined by a second wheel roller 282. For instance, the second roller diameter d2 may be greater than the first roller diameter d1. Optionally, an identical profile 286 may be defined by each of the corresponding cam lobes 280. Notably, the corresponding second lifter arm 242 may be raised higher the than the raised position of the first lifter arm 242. Additionally or alternatively, a slight delay may be provided in the lifting or ejection of a portion of the ice cubes.

Returning generally to FIGS. 3 through 12, in optional embodiments, drive mechanism 276 further includes a yoke wheel 290 which is mechanically coupled to motor 278 for driving sweep assembly 260. Specifically, yoke wheel 290 may rotate along with cam shaft 284 and may include a drive pin 292 positioned at a radially outer portion of yoke wheel 290 and extending substantially parallel to an axis of rotation of motor 278 (e.g., an axial direction). In addition, side arms of sweep assembly 260 may define a drive slot 294 which is configured to receive drive pin 292 during operation.

Notably, the geometry of each drive slot 294 is defined such that drive pin 292 moves sweep assembly 260 along the horizontal direction when drive pin 292 reaches an end of drive slot 294. Notably, according to an exemplary embodiment, this occurs when lifter mechanism is in the raised position. In order to provide controller 164 with knowledge of the position of yoke wheel 290 (and drive mechanism 276 more generally), ice making assembly 200 may include a position sensor for determining a zero position of yoke wheel 290.

According to an exemplary embodiment the present subject matter, motor 278 may begin to rotate after ice cubes 204 are completely frozen and ready for harvest. In this regard, motor 278 rotates rotating cam 280 (or cam shaft 284) approximately 90 degrees to move lifter mechanism from the lowered position to the raised position. In this manner, lifter projection 246 pushes ice mold 210 or ice cubes 204 generally upward (e.g., thereby deforming ice mold 210) and releasing ice cubes 204. Ice cubes 204 may continue to be pushed upward until a front edge of ice cubes 204 contacts a forward flange such that lifter projection 246 rotates a rear end of ice cubes 204 upward.

Optionally, yoke wheel 290 may rotate with cam shaft 284 such that drive pin 292 rotates within drive slot 294 without moving sweep assembly 260 until yoke wheel 290 reaches a 900 position. Thus, as motor 278 rotates past 90 degrees, lifter mechanism remains in the raised position while sweep assembly 260 moves towards the extended position to push ice cubes 204 out of ice mold 210 and into storage bin 152. When motor 278 reaches 180 degrees rotation, sweep assembly 260 is in the fully extended position and ice cubes 204 will fall into storage bin 152 under the force of gravity. As motor 278 rotates past 180 degrees, drive pin 292 may begin to pull sweep assembly 260 back toward the retracted position, e.g., via engagement with drive slot 294. Simultaneously, the profile of rotating cam 280 is configured to begin lowering lifter mechanism. When motor 278 is rotated back to the zero position, sweep assembly 260 may be fully retracted, lifter mechanism may be fully lowered, and ice mold 210 may be ready for a supply fresh water. At this time, water supply spout 202 may provide a flow of fresh water into mold cavities 212 and the process may be repeated.

Referring now generally to FIGS. 4 and 13 through 28, ice making assembly 200 may include a housing 310 that defines a receiving chamber 350 which is in fluid communication with the inlet air duct 224, and a removable mold assembly 400 which is insertable into the receiving chamber 350. The housing 310 may include a first side end or wall 320 and a second side end or wall 322 opposite the first side wall 320. The first and second side walls 320, 322 may extend from a front 230 of the ice making assembly 200 toward a rear 228 of the ice making assembly 200 (e.g., in the lateral direction L). Moreover, housing 310 may further define a first mounting slot 324 (e.g., at or through first side wall 320) and a second mounting slot 326 (e.g., at or through second side wall 322). As will be discussed in greater detail below, one or more mounting features (e.g., a latch bar 314) may be engaged with or received by the first and second mounting slots 324, 326, such as to hold the removable mold assembly 400 in place within the receiving chamber 350.

As shown, ice making assembly 200 further includes a frame 410 configured for receipt within the receiving chamber 350. Generally, the frame 410 may include a mold frame and define a front panel, a rear panel, a first side panel, and a second side panel. The mold frame may support the heat exchanger 220. In some embodiments, the heat exchanger 220 is located between the first side panel and the second side panel of the frame 410. The heat exchanger 220 may include a mold support surface in contact with the ice mold 210. The mold support surface may include cube recess 222. The mold support surface may support the flexible mold 210 and provide a direct contact for heat exchange.

As noted above, ice making assembly 200 may include one or more retention features for securing the removable mold assembly 200 within the receiving chamber 350. In some embodiments, a latch bar 314 is movably mounted on the frame 410. Specifically, latch bar 314 may be secured to frame 410 in a manner that permits movement (e.g., contraction or rotation) of at least a portion of latch bar 314 relative to frame 410. The movable portion may include at least one rigid post (e.g., first post 336 or second post 338). As shown, latch bar 314 extends (e.g., transversely) between a first bar end 316 and a second bar end 318. When assembled (e.g., to secure mold assembly 400 within receiving chamber 350), first bar end 316 is disposed proximal to first housing end 320 (i.e., distal to second housing end 322) and second bar end 318 is disposed proximal to second housing end 322 (i.e., distal to first housing end 320). In turn, latch bar 314 is oriented to extend (e.g., transversely) between first housing end 320 and second housing end 322. As shown, latch bar 314 may be in selective locked engagement with the first and second mounting slots 324, 326 (e.g., at the first and second bar ends 316, 318, respectively) to secure the mold assembly to the housing 310.

In some embodiments, latch bar 314 is attached to the front wall 340 of the housing 310 and to retain the removable mold assembly 200 within the receiving chamber 350 of the housing 310. For instance, one or more support tabs 240 may extend (e.g., vertically in front of heat exchanger 220 or fins 232) to vertically locate or hold latch bar 314 in place. Optionally, a support tab 240 may include a bottom tab member 242A fixed to (e.g., and extending vertically upward from) frame 410 and a top tab member 242B fixed to (e.g., and extending vertically downward from) frame 410 to sandwich latch bar 314 between the bottom and top tab members 242A, 242B. As shown, multiple support tabs 240 may be provided and transversely spaced apart along the frame 410 (e.g., between the first housing end 320 and the second housing end 322).

Referring especially to FIGS. 13 through 23, latch bar 314 may include one or more rigid posts 336, 338 that are horizontally (e.g., transversely) slidable relative to the housing 310. In some such embodiments, a first post 336 and a second post 338 are provided in parallel to each other. Between the first and second posts 336, 338, a compressible spring segment 352 segment 352 may be provided to horizontally (e.g., transversely) contract (e.g., as directed by a user for removal from or insertion into receiving chamber 350). Thus, compressible spring segment 352 may be contracted (e.g., by a user's grip) to move first and second posts 336, 338 horizontally relative to each other.

When assembled, a compressible spring segment 352 may connect the first and second posts 336, 338. In some embodiments, such as those shown in FIGS. 13, 14, and 20, compressible spring segment 352 may include or be provided as a bent or folded leaf spring, such as an M-shaped leaf spring. During assembly or disassembly, folds of the leaf spring may be pushed towards each other such that first post 336 and second post 338 can be placed within or removed from first mounting slot 324 and second mounting slot 326, respectively. In additional or alternative embodiments, such as those shown in FIGS. 13 and 14, the compressible spring segment 352 may include one or more crest 354 from which a thumb hook 356 extends (e.g., transversely) to notably aid a user's grip on, and compression of, latch bar 314.

Figure 22:
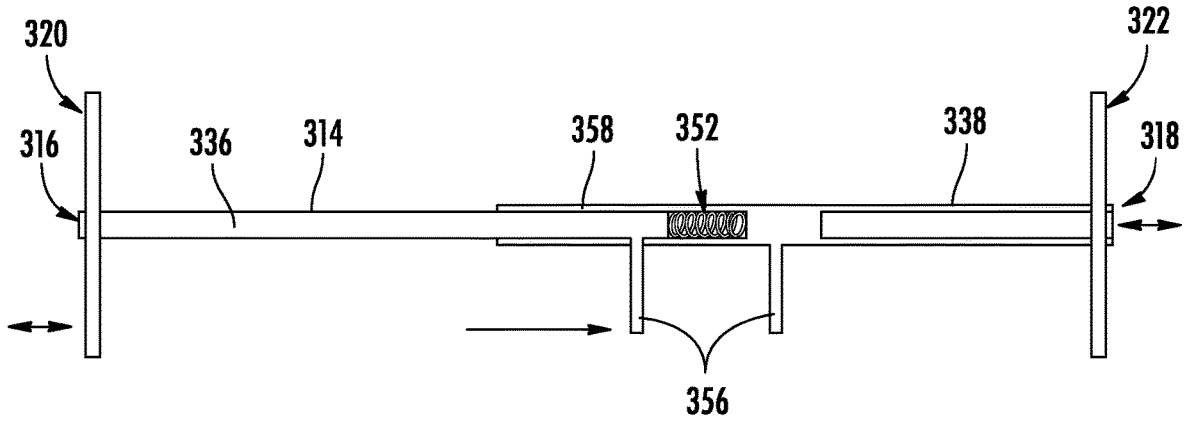
FIG. 22 provides a schematic section view of a latch bar of an ice making assembly according to exemplary embodiments of the present disclosure.
Figure 23:
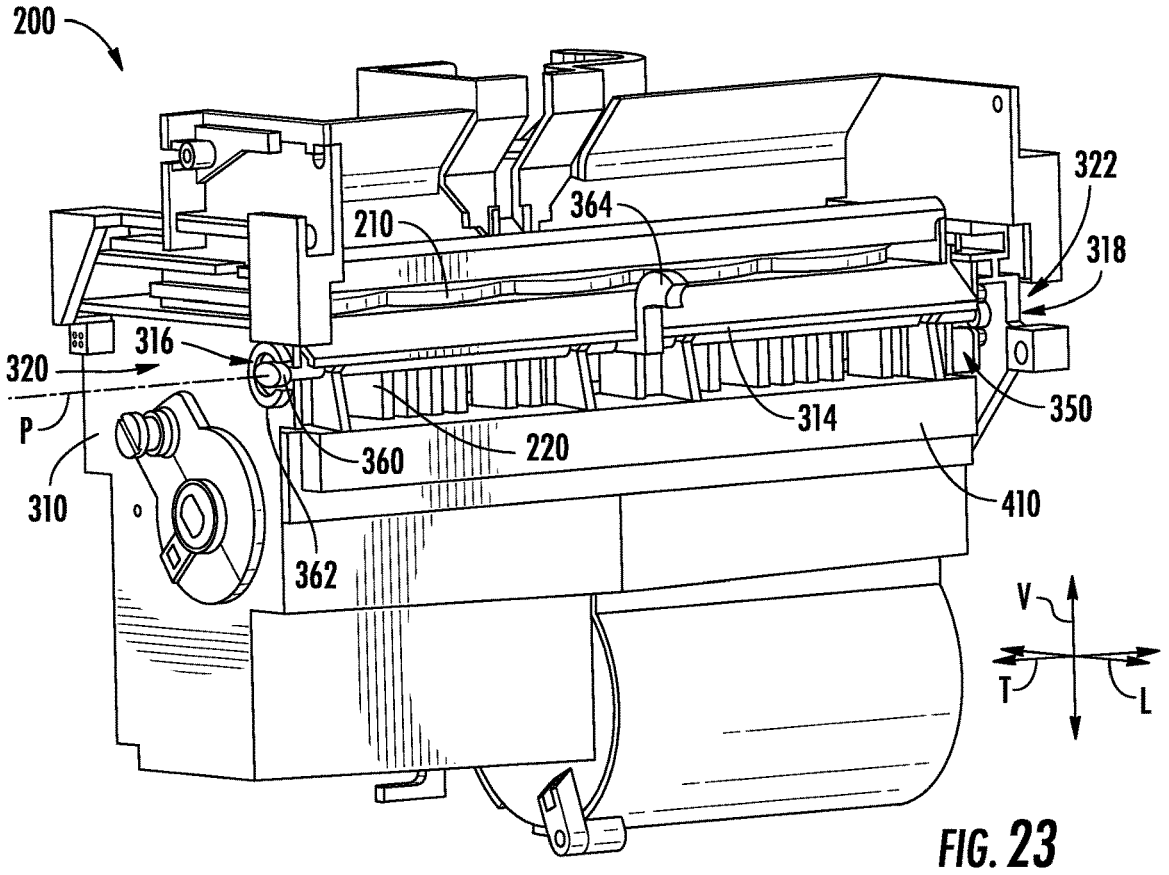
FIG. 23 provides a perspective view of an exemplary ice making assembly, wherein the latch bar is in an unlocked position.
Figure 24:
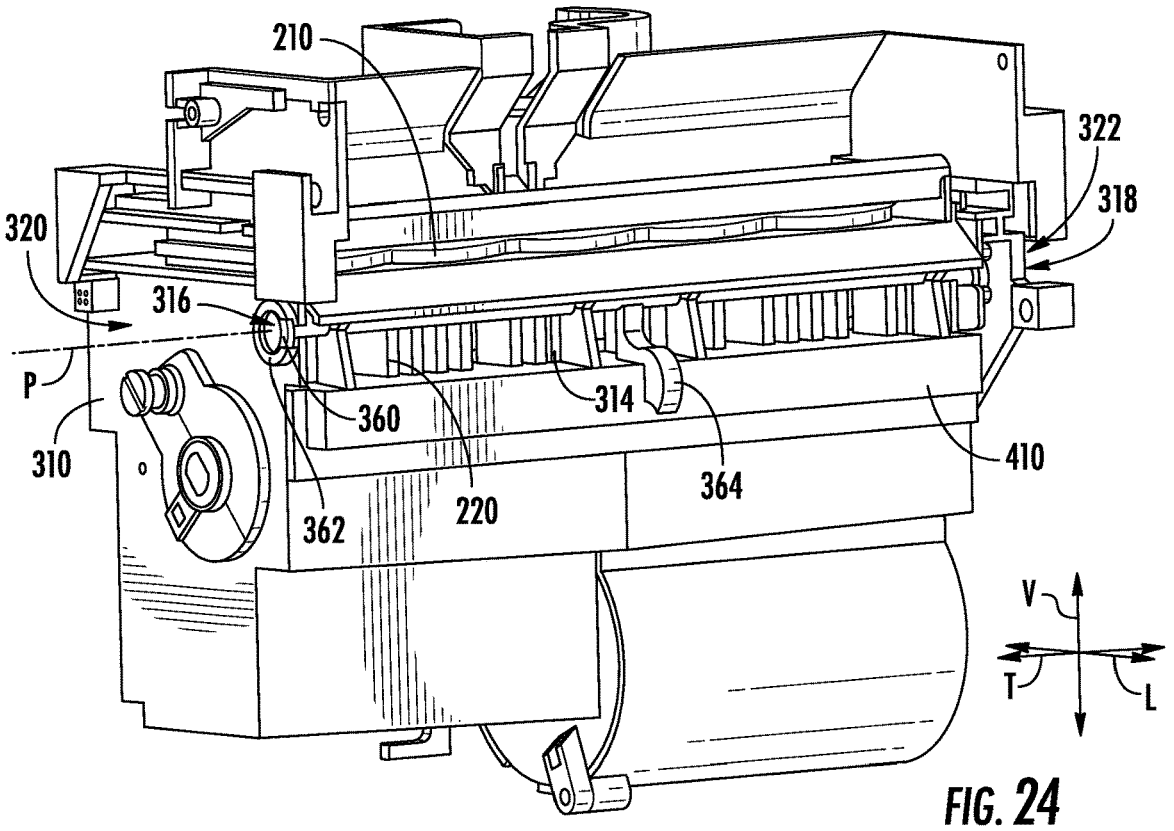
FIG. 24 provides a perspective view of an exemplary ice making assembly, wherein the latch bar is in a locked position.
Figure 25:
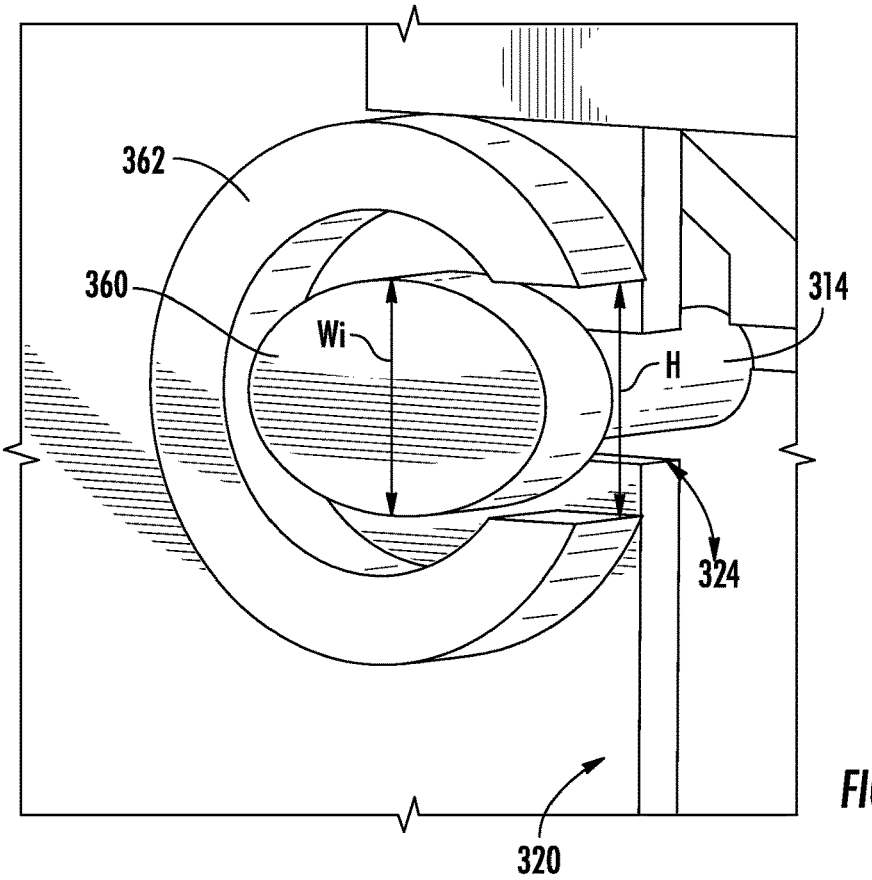
FIG. 25 provides a magnified perspective view of a portion of the exemplary ice making assembly of FIGS. 23 and 24, wherein the latch bar is in the locked position.
Figure 26:
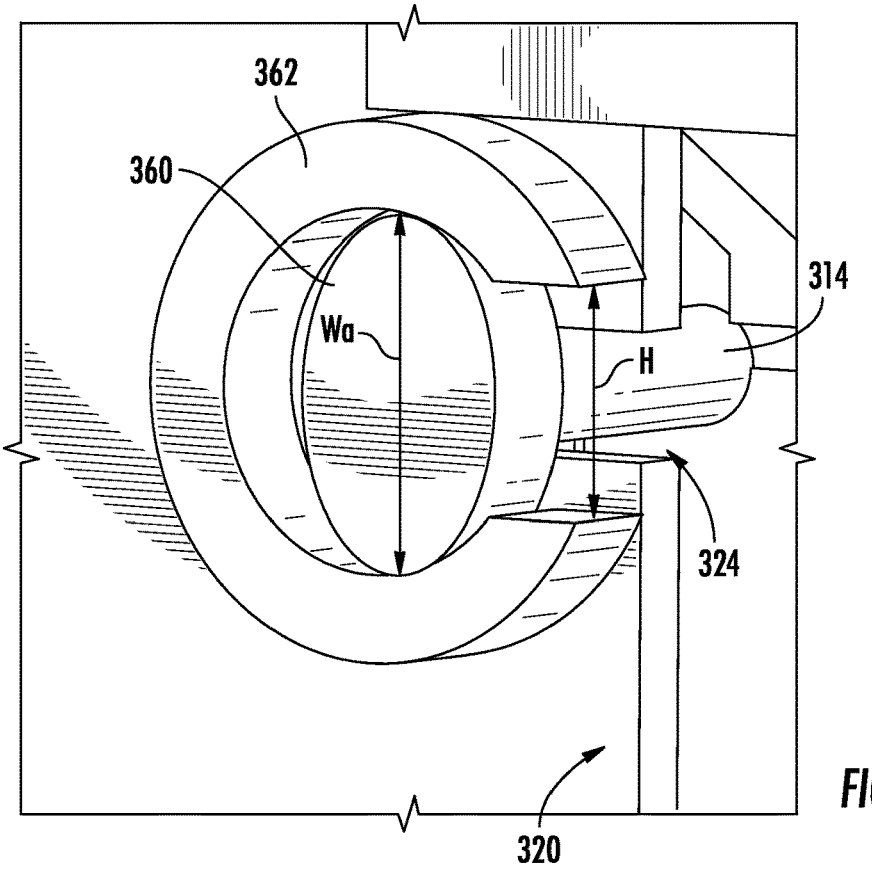
FIG. 26 provides a perspective view of a portion of the exemplary ice making assembly of FIGS. 23 and 24, wherein the latch bar is in a locked position.
Figure 27:
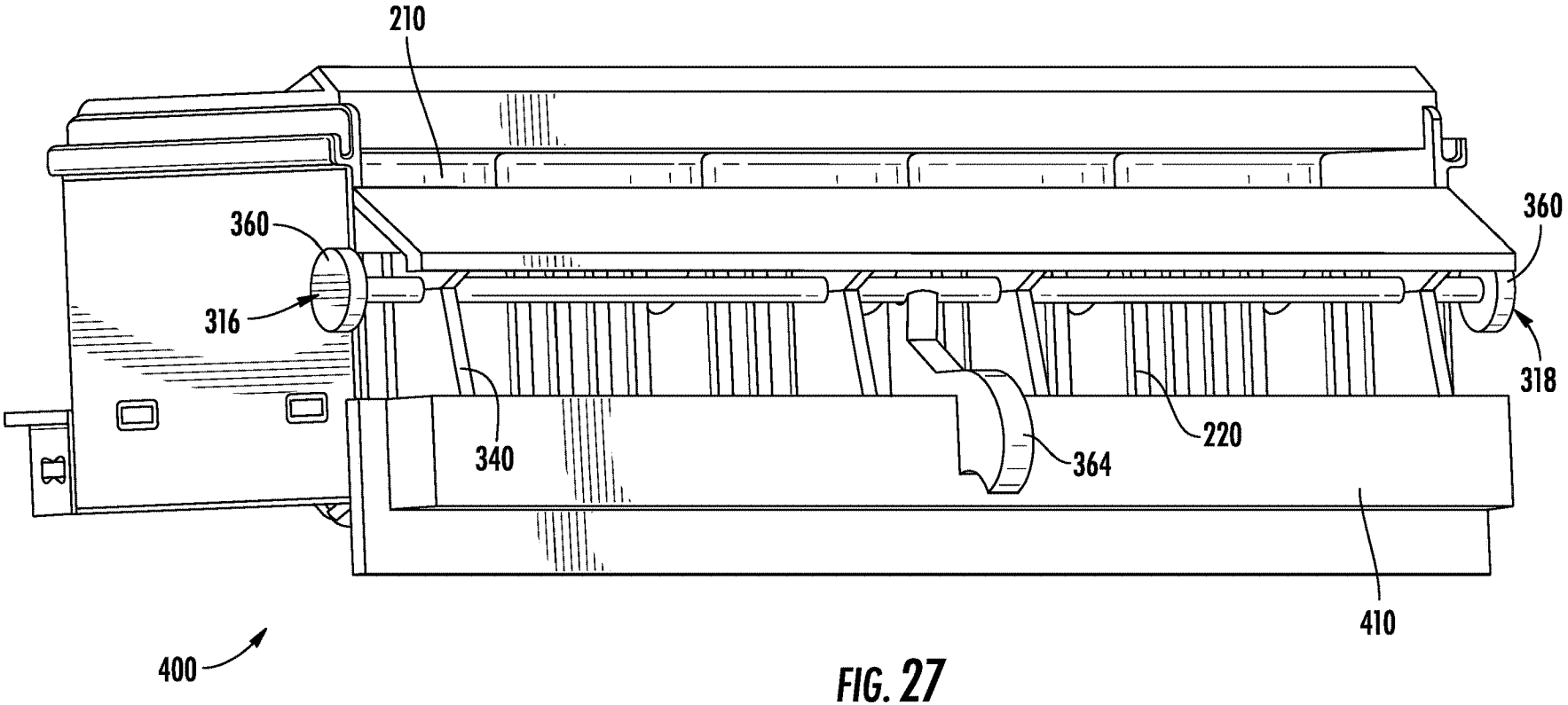
FIG. 27 provides a perspective view of a portion of the exemplary ice making assembly of FIGS. 23 and 24.
Figure 28:
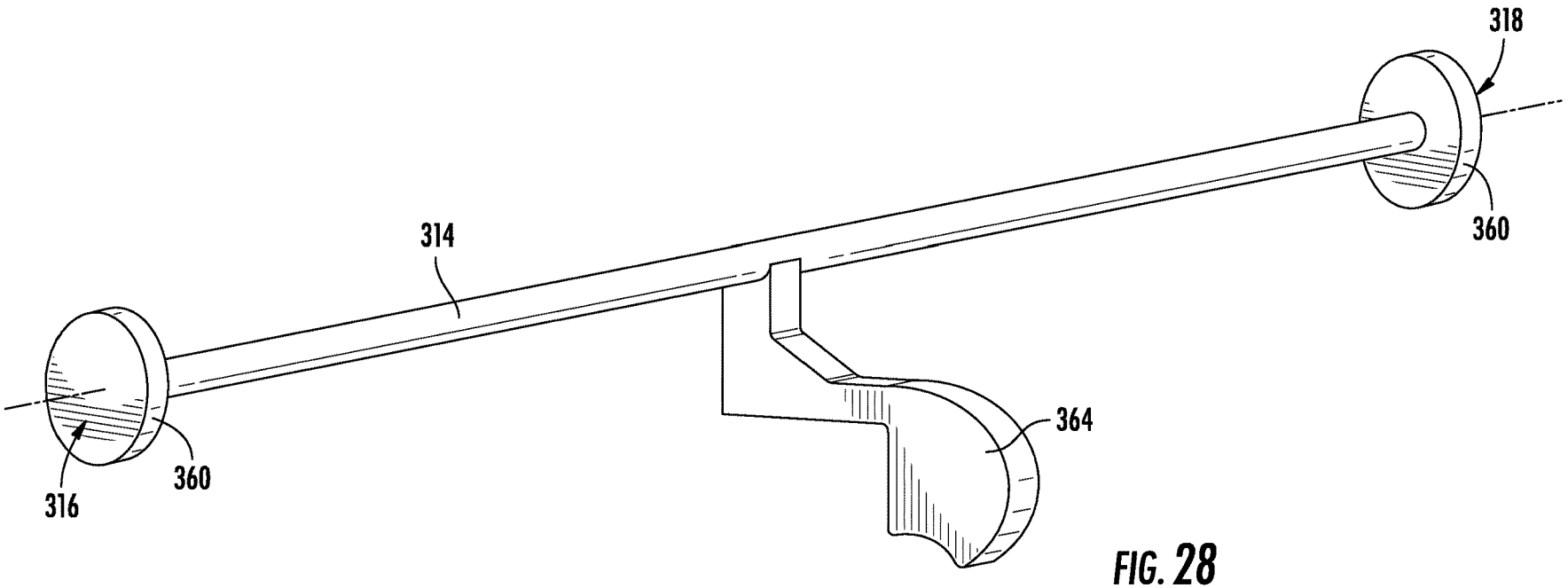
FIG. 28 provides a perspective view of the latch bar of the exemplary ice making assembly of FIGS. 23 and 24.

In further additional or alternative embodiments, such as those shown in FIGS. 22 and 23, compressible spring segment 352 is received within a guide sleeve 358. Compressible spring segment 352 may be, for instance, a coiled compression spring. At least a portion of first post 336 and second post 338 may further be received within the guide sleeve 358. The guide sleeve 358 may be slidable relative to both first and second posts 336, 338 (e.g., as shown in FIG. 22) or, alternatively, fixed to one post (e.g., second post 338, as shown in FIG. 23) such that the post and the guide sleeve 358 move in tandem relative to the other post (e.g., first post 336). Optionally, a discrete thumb hook 356 may extend (e.g., laterally) from each of the first and second posts 336, 338 to notably aid a user's grip on, and compression of, latch bar 314.

Referring especially to FIGS. 24 through 28, latch bar 314 may define a pivot axis P (e.g., with support tabs 240) about latch bar 314 is rotatable relative to the frame 410. When assembled, latch bar 314 move (e.g., rotate) between a locked position (e.g., FIG. 25) and an unlocked position (e.g., FIG. 24). A first oval plug 360 and a second oval plug 360 may be included with the latch bar 314 (e.g., at the first bar end 316 and the second bar end 318, respectively). In some such embodiments, housing 310 includes a first C-shaped retention ridge 362 (e.g., on the first housing end 320 about the first mounting slot 324) and a second C-shaped retention ridge 362 (e.g., on the second housing end 322 about the second mounting slot 326) within which the first and second oval plugs 360 may be received. As shown, the first and second mounting slots 324, 326 may be transversely open (e.g., in parallel to the C-shaped retention ridges 362). The oval plugs 360 may each define a minor axis width Wi that is less than an opening height H of the respective C-shaped retention ridge 362 and a major axis width Wa that is greater than the opening height H. In the locked position, the oval plugs 360 may hold each major axis non-orthogonally (e.g., parallel) relative to the corresponding opening height H. Thus, the oval plugs 360, latch bar 314, and frame 410 generally, may be restricted or prevented from sliding away from housing 310. By contrast, in the unlocked position, the oval plugs 360 may hold each minor axis Wi non-orthogonally (e.g., parallel) relative to the corresponding opening height H. Thus, the oval plugs 360, latch bar 314, and frame 410 generally may be permitted to slide relative to and apart from housing 310. Optionally, an engagement finger 364 may be provided to rest against a portion of the frame 410 (e.g., front face) in the locked position and be moved apart from the frame 410 in the unlocked position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigerator appliance defining a vertical direction, a lateral direction, and a transverse direction, the ice making assembly comprising:

a housing defining a receiving chamber in fluid communication with an air duct, the housing extending transversely from a first housing end and a second housing end, the housing defining a first mounting slot at the first housing end and a second mounting slot at the second housing end; and a mold assembly removably mounted to the housing, the mold assembly comprising:

a frame configured for receipt within the receiving chamber, a heat exchanger mounted to the frame, an ice mold supported on the heat exchanger and defining a mold cavity for receiving water, and a latch bar movably mounted on the frame and extending transversely between the first housing end and the second housing end in selective locked engagement with the first and second mounting slots to secure the mold assembly to the housing.

2. The ice making assembly of claim 1, further comprising a plurality of support tabs transversely spaced apart along the frame, the plurality of support tabs holding the latch bar on the frame.

3. The ice making assembly of claim 1, wherein the latch bar comprises a rigid post horizontally slidable relative to the housing.

4. The ice making assembly of claim 1, wherein the latch bar comprises a first rigid post, a second rigid post parallel to the first rigid post, and a compressible spring segment connecting the first and second rigid posts.

5. The ice making assembly of claim 4, wherein the compressible spring segment comprises an M-shaped leaf spring.

6. The ice making assembly of claim 4, wherein the compressible spring segment defines a first crest, and wherein the latch bar further comprises a first thumb hook extending outward from the first crest.

7. The ice making assembly of claim 4, wherein the latch bar further comprises a guide sleeve within which the compressible spring segment and a portion of the first rigid post is received.

8. The ice making assembly of claim 1, wherein the latch bar defines a pivot axis about which the latch bar is rotatable relative to the frame between a locked and an unlocked position within the first and second mounting slots.

9. The ice making assembly of claim 8, wherein the housing further comprises a first C-shaped retention ridge extending about the first mounting slot and a second C-shaped retention ridge extending about the second mounting slot, and wherein the latch bar further comprises a first oval plug rotatably received within the first C-shaped retention ridge and a second oval plug rotatably received within the second C-shaped retention ridge.

10. A refrigerator appliance defining a vertical direction, a lateral direction, and a transverse direction, comprising:

a cabinet defining a chilled chamber;

a door being rotatably mounted to the cabinet to provide selective access to the chilled chamber;

an icebox mounted to the door and defining an ice making chamber; and an ice making assembly positioned within the ice making chamber, the ice making assembly comprising:

a housing defining a receiving chamber in fluid communication with an air duct, the housing extending transversely from a first housing end and a second housing end, the housing defining a first mounting slot at the first housing end and a second mounting slot at the second housing end, a frame configured for receipt within the receiving chamber, a heat exchanger mounted to the frame, an ice mold supported on the heat exchanger and defining a mold cavity for receiving water, and a latch bar movably mounted on the frame and extending transversely between the first housing end and the second housing end in selective locked engagement with the first and second mounting slots to secure the frame to the housing.

11. The refrigerator appliance of claim 10, further comprising a plurality of support tabs transversely spaced apart along the frame, the plurality of support tabs holding the latch bar on the frame.

12. The refrigerator appliance of claim 10, wherein the latch bar comprises a rigid post horizontally slidable relative to the housing.

13. The refrigerator appliance of claim 10, wherein the latch bar comprises a first rigid post, a second rigid post parallel to the first rigid post, and a compressible spring segment connecting the first and second rigid posts.

14. The refrigerator appliance of claim 13, wherein the compressible spring segment comprises an M-shaped leaf spring.

15. The refrigerator appliance of claim 13, wherein the compressible spring segment defines a first crest, and wherein the latch bar further comprises a first thumb hook extending outward from the first crest.

16. The refrigerator appliance of claim 13, wherein the latch bar further comprises a guide sleeve within which the compressible spring segment and a portion of the first rigid post is received.

17. The refrigerator appliance of claim 10, wherein the latch bar defines a pivot axis about which the latch bar is rotatable relative to the frame between a locked and an unlocked position within the first and second mounting slots.

18. The refrigerator appliance of claim 17, wherein the housing further comprises a first C-shaped retention ridge extending about the first mounting slot and a second C-shaped retention ridge extending about the second mounting slot, and wherein the latch bar further comprises a first oval plug rotatably received within the first C-shaped retention ridge and a second oval plug rotatably received within the second C-shaped retention ridge.

* * * * *